US010881566B2

(12) United States Patent
Jackson

(10) Patent No.: US 10,881,566 B2
(45) Date of Patent: Jan. 5, 2021

(54) PATIENT SUPPORT APPARATUS WITH BODY SLIDE POSITION DIGITALLY COORDINATED WITH HINGE ANGLE

(71) Applicant: WARSAW ORTHOPEDIC, INC., Warsaw, IN (US)

(72) Inventor: Roger P. Jackson, Prairie Village, KS (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 714 days.

(21) Appl. No.: 15/661,261

(22) Filed: Jul. 27, 2017

(65) Prior Publication Data

US 2017/0319411 A1 Nov. 9, 2017

Related U.S. Application Data

(63) Continuation of application No. 13/956,728, filed on Aug. 1, 2013, now Pat. No. 9,744,087, which is a (Continued)

(51) Int. Cl.
*A61G 7/015* (2006.01)
*A61G 13/00* (2006.01)
(Continued)

(52) U.S. Cl.
CPC ..... *A61G 7/015* (2013.01); *A61G 13/0036* (2013.01); *A61G 13/0054* (2016.11);
(Continued)

(58) Field of Classification Search
CPC ..... A61G 7/015; A61G 7/018; A61G 13/02; A61G 13/004; A61G 13/04; A61G 13/06; A61G 13/08; A61G 13/10
See application file for complete search history.

(56) References Cited

U.S. PATENT DOCUMENTS 377,377 A 2/1888 Ferry
392,743 A 11/1888 Millen
(Continued)

FOREIGN PATENT DOCUMENTS

CN 2467091 Y 12/2001
EP 2226010 B1 6/2014
(Continued)

OTHER PUBLICATIONS

Brochure of Smith & Nephew on Spinal Positioning System, 2003, 2004.

(Continued)

*Primary Examiner* — Peter M. Cuomo
*Assistant Examiner* — Ifeolu A Adeboyejo
(74) *Attorney, Agent, or Firm* — Sorell, Lenna & Schmidt, LLP

(57) ABSTRACT

An articulated patient support apparatus includes upper and lower body support frames hinged together to form a patient support assembly which is hinged to head and foot end supports. One end of the assembly includes a length compensator to enable hinged angulation between the body support frames. Hinge motors are connected between the frames to cause hinged articulation therebetween. One or both of the body support frames has a body slide assembly mounted thereon to enable part of a patient's body to move linearly along the particular body support frame by operation of a slide motor to compensate for hinged articulation of the frames. The hinge motors and slide motor have encoders interfaced to a controller to digitally coordinate sliding movement with hinging articulation.

21 Claims, 20 Drawing Sheets

Related U.S. Application Data continuation-in-part of application No. 13/986,060, filed on Mar. 14, 2013, now Pat. No. 9,301,897, which is a continuation-in-part of application No. 12/803,192, filed on Jun. 21, 2010, now Pat. No. 9,186,291, said application No. 13/956,728 is a continuation-in-part of application No. 13/374,034, filed on Dec. 8, 2011, now Pat. No. 9,308,145, which is a continuation-in-part of application No. 12/460,702, filed on Jul. 23, 2009, now Pat. No. 8,060,960, and a continuation of application No. 11/788,513, filed on Apr. 20, 2007, now Pat. No. 7,565,708, which is a continuation-in-part of application No. 11/159,494, filed on Jun. 23, 2005, now Pat. No. 7,343,635, which is a continuation-in-part of application No. 11/062,775, filed on Feb. 22, 2005, now Pat. No. 7,152,261, said application No. 13/956,728 is a continuation-in-part of application No. 13/694,392, filed on Nov. 28, 2012, now abandoned.

(60) Provisional application No. 61/742,098, filed on Aug. 2, 2012, provisional application No. 61/743,240, filed on Aug. 29, 2012, provisional application No. 61/849,035, filed on Jan. 17, 2013, provisional application No. 61/795,649, filed on Oct. 22, 2012, provisional application No. 61/849,016, filed on Jan. 17, 2013, provisional application No. 61/852,199, filed on Mar. 15, 2013, provisional application No. 61/459,264, filed on Dec. 9, 2010, provisional application No. 60/798,288, filed on May 5, 2006, provisional application No. 61/629,815, filed on Nov. 28, 2011.

(51) Int. Cl.

| | |
|---|---|
| ***A61G 13/02*** | (2006.01) |
| ***A61G 13/12*** | (2006.01) |
| ***A61G 13/04*** | (2006.01) |
| ***A61G 13/06*** | (2006.01) |
| ***A61G 13/08*** | (2006.01) |

(52) U.S. Cl.

CPC ..... *A61G 13/02* (2013.01); *A61G 13/04* (2013.01); *A61G 13/06* (2013.01); *A61G 13/08* (2013.01); *A61G 13/123* (2013.01)

(56) References Cited

U.S. PATENT DOCUMENTS

| | | | | | |
|---|---|---|---|---|---|
| 430,635 | A | | 6/1890 | Fox | |
| 769,415 | A | * | 9/1904 | Smock | A61G 7/015 5/617 |
| 987,423 | A | | 3/1911 | Barnett | |
| 1,032,743 | A | * | 7/1912 | Courtney | A61G 7/015 5/618 |
| 1,046,430 | A | * | 12/1912 | Beitz | A61G 7/015 5/617 |
| 1,098,209 | A | * | 5/1914 | Allen | A61G 7/015 5/617 |
| 1,098,477 | A | | 6/1914 | Cashman | |
| 1,143,618 | A | | 6/1915 | Ewald | |
| 1,160,451 | A | | 11/1915 | Sanford | |
| 1,171,713 | A | | 2/1916 | Gilkerson | |
| 1,356,467 | A | | 10/1920 | Payne | |
| 1,404,482 | A | | 1/1922 | Sawyer | |
| 1,482,439 | A | | 2/1924 | McCullough | |
| 1,524,399 | A | | 1/1925 | Krueger | |
| 1,528,835 | A | | 3/1925 | McCullough | |
| 1,667,982 | A | | 5/1928 | Pearson | |
| 1,780,399 | A | | 11/1930 | Munson | |
| 1,799,692 | A | | 4/1931 | Knott | |
| 1,938,006 | A | | 12/1933 | Blanchard | |
| 1,990,357 | A | | 2/1935 | Ward | |
| 2,188,592 | A | | 1/1940 | Hosken et al. | |
| 2,261,297 | A | | 11/1941 | Seib | |
| 2,411,768 | A | | 11/1946 | Welch | |
| 2,475,003 | A | | 7/1949 | Black | |
| 2,636,793 | A | | 4/1953 | Meyer | |
| 2,688,410 | A | | 9/1954 | Nelson | |
| 2,792,945 | A | | 5/1957 | Brenny | |
| 3,046,071 | A | | 7/1962 | Shampaine et al. | |
| 3,049,726 | A | | 8/1962 | Getz | |
| 3,281,141 | A | | 10/1966 | Smiley et al. | |
| 3,302,218 | A | | 2/1967 | Stryker | |
| 3,584,321 | A | | 6/1971 | Buchanan | |
| 3,599,964 | A | | 8/1971 | Magni | |
| 3,640,416 | A | | 2/1972 | Temple | |
| 3,766,384 | A | | 10/1973 | Anderson | |
| 3,814,414 | A | * | 6/1974 | Chapa | A61B 6/04 5/601 |
| 3,827,089 | A | | 8/1974 | Grow | |
| 3,832,742 | A | | 9/1974 | Stryker | |
| 3,868,103 | A | | 2/1975 | Pageot et al. | |
| 3,937,054 | A | | 2/1976 | Hortvet et al. | |
| 3,988,790 | A | | 11/1976 | Mracek et al. | |
| 4,101,120 | A | | 7/1978 | Seshima | |
| 4,131,802 | A | | 12/1978 | Braden et al. | |
| 4,144,880 | A | | 3/1979 | Daniels | |
| 4,148,472 | A | | 4/1979 | Rais et al. | |
| 4,175,550 | A | * | 11/1979 | Leininger | 5/109 |
| 4,186,917 | A | | 2/1980 | Rais et al. | |
| 4,195,829 | A | | 4/1980 | Reser | |
| 4,227,269 | A | | 10/1980 | Johnston | |
| 4,230,100 | A | | 10/1980 | Moon | |
| 4,244,358 | A | | 1/1981 | Pyers | |
| 4,292,962 | A | | 10/1981 | Krause | |
| 4,391,438 | A | | 7/1983 | Heffington, Jr. | |
| 4,435,861 | A | | 3/1984 | Lindley | |
| 4,474,364 | A | | 10/1984 | Brendgord | |
| 4,503,844 | A | | 3/1985 | Siczek | |
| 4,552,346 | A | | 11/1985 | Schnelle et al. | |
| 4,712,781 | A | | 12/1987 | Watanabe | |
| 4,715,073 | A | | 12/1987 | Butler | |
| 4,718,077 | A | | 1/1988 | Moore et al. | |
| 4,763,643 | A | | 8/1988 | Vrzalik | |
| 4,771,785 | A | | 9/1988 | Duer | |
| 4,830,337 | A | | 5/1989 | Ichiro et al. | |
| 4,850,775 | A | | 7/1989 | Lee et al. | |
| 4,862,529 | A | | 9/1989 | Peck | |
| 4,872,656 | A | | 10/1989 | Brendgord et al. | |
| 4,872,657 | A | | 10/1989 | Lussi | |
| 4,887,325 | A | | 12/1989 | Tesch | |
| 4,937,901 | A | | 7/1990 | Brennan | |
| 4,939,801 | A | | 7/1990 | Schaal et al. | |
| 4,944,500 | A | | 7/1990 | Mueller et al. | |
| 4,953,245 | A | | 9/1990 | Jung | |
| 4,970,737 | A | | 11/1990 | Sagel | |
| 4,989,848 | A | | 2/1991 | Monroe | |
| 5,013,018 | A | | 5/1991 | Sicek et al. | |
| 5,088,706 | A | | 2/1992 | Jackson | |
| 5,131,103 | A | * | 7/1992 | Thomas | A61B 5/0555 128/870 |
| 5,131,105 | A | | 7/1992 | Harrawood et al. | |
| 5,131,106 | A | | 7/1992 | Jackson | |
| 5,161,267 | A | | 11/1992 | Smith | |
| 5,163,890 | A | | 11/1992 | Perry, Jr. | |
| 5,181,289 | A | | 1/1993 | Kassai | |
| 5,208,928 | A | | 5/1993 | Kuck et al. | |
| 5,210,887 | A | | 5/1993 | Kershaw | |
| 5,210,888 | A | | 5/1993 | Canfield | |
| 5,230,112 | A | | 7/1993 | Harrawood et al. | |
| 5,231,741 | A | | 8/1993 | Maguire | |
| 5,239,716 | A | | 8/1993 | Fisk | |
| 5,274,862 | A | | 1/1994 | Palmer, Jr. | |
| 5,294,179 | A | | 3/1994 | Rudes et al. | |
| 5,333,334 | A | | 8/1994 | Kassai | |
| 5,393,018 | A | | 2/1995 | Roth et al. | |
| 5,444,882 | A | | 8/1995 | Andrews et al. | |
| 5,461,740 | A | | 10/1995 | Pearson | |

(56) References Cited

U.S. PATENT DOCUMENTS 5,468,216 A 11/1995 Johnson et al.
5,487,195 A 1/1996 Ray
5,499,408 A 3/1996 Nix
5,524,304 A 6/1996 Shutes
5,544,371 A 8/1996 Fuller
5,579,550 A 12/1996 Bathrick et al.
5,588,705 A 12/1996 Chang
5,613,254 A * 3/1997 Clayman ..... A61B 6/0442 5/172
5,640,730 A 6/1997 Godette
5,645,079 A 7/1997 Zahiri et al.
5,658,315 A 8/1997 Lamb et al.
5,659,909 A 8/1997 Pfeuffer et al.
5,673,443 A 10/1997 Marmor
5,737,781 A 4/1998 Votel
5,754,997 A 5/1998 Lussi et al.
5,774,914 A 7/1998 Johnson et al.
5,794,286 A 8/1998 Scott et al.
5,829,077 A 11/1998 Neige
5,862,549 A 1/1999 Morton et al.
5,870,784 A 2/1999 Elliott
5,890,238 A 4/1999 Votel
5,901,388 A 5/1999 Cowan
5,937,456 A 8/1999 Norris
5,940,911 A 8/1999 Wang
5,996,151 A 12/1999 Bartow et al.
6,000,076 A 12/1999 Webster et al.
6,035,465 A 3/2000 Rogozinski
6,049,923 A 4/2000 Ochiai
6,058,532 A 5/2000 Allen
6,109,424 A 8/2000 Doan
6,212,713 B1 4/2001 Kuck et al.
6,224,037 B1 5/2001 Novick
6,240,582 B1 6/2001 Reinke
6,260,220 B1 * 7/2001 Lamb ..... A61G 13/02 5/601
6,282,736 B1 9/2001 Hand et al.
6,282,738 B1 9/2001 Heimbrock et al.
6,286,164 B1 9/2001 Lamb et al.
6,287,241 B1 9/2001 Ellis
6,295,666 B1 * 10/2001 Takaura ..... A61G 7/001 5/611
6,295,671 B1 10/2001 Reesby et al.
6,315,564 B1 11/2001 Levisman
6,322,251 B1 11/2001 Ballhaus et al.
6,438,777 B1 8/2002 Bender
6,496,991 B1 12/2002 Votel
6,499,162 B1 12/2002 Lu
6,505,365 B1 1/2003 Hanson et al.
6,526,610 B1 3/2003 Hand et al.
6,634,043 B2 10/2003 Lamb et al.
6,638,299 B2 10/2003 Cox
6,662,388 B2 12/2003 Friel
6,668,396 B2 12/2003 Wei
6,681,423 B2 1/2004 Zachrisson
6,701,553 B1 3/2004 Hand et al.
6,779,210 B1 8/2004 Kelly
6,791,997 B2 9/2004 Beyer et al.
6,794,286 B2 9/2004 Aoyama et al.
6,817,363 B2 11/2004 Biondo et al.
6,854,137 B2 2/2005 Johnson
6,857,144 B1 2/2005 Huang
6,862,759 B2 3/2005 Hand et al.
6,885,165 B2 4/2005 Henley et al.
6,971,131 B2 * 12/2005 Bannister ..... A61G 13/02 5/610
6,971,997 B1 12/2005 Ryan et al.
7,003,828 B2 2/2006 Roussy
7,055,195 B2 6/2006 Roussy
7,089,612 B2 8/2006 Rocher et al.
7,103,931 B2 9/2006 Somasundaram et al.
7,137,160 B2 11/2006 Hand et al.
7,152,261 B2 12/2006 Jackson
7,171,709 B2 2/2007 Weismiller
7,189,214 B1 3/2007 Saunders
7,197,778 B2 4/2007 Sharps
7,213,279 B2 5/2007 Weismiller et al.
7,234,180 B2 6/2007 Horton et al.
7,290,302 B2 11/2007 Sharps
7,331,557 B2 2/2008 Dewert
7,343,635 B2 3/2008 Jackson
7,428,760 B2 9/2008 McCrimmon
7,437,785 B2 10/2008 Farooqui
7,552,490 B2 6/2009 Saracen et al.
7,565,708 B2 7/2009 Jackson
7,596,820 B2 10/2009 Nielsen et al.
7,653,953 B2 2/2010 Lopez-Sansalvador
7,669,262 B2 3/2010 Skripps et al.
7,739,762 B2 6/2010 Lamb et al.
7,874,030 B2 1/2011 Cho et al.
7,874,695 B2 1/2011 Jensen
7,882,583 B2 2/2011 Skripps
8,056,163 B2 11/2011 Lemire et al.
8,060,960 B2 11/2011 Jackson
8,381,331 B2 2/2013 Sharps et al.
8,584,281 B2 11/2013 Diel et al.
8,635,725 B2 1/2014 Tannoury et al.
8,677,529 B2 3/2014 Jackson
8,707,476 B2 4/2014 Sharps
8,707,484 B2 4/2014 Jackson
8,719,979 B2 5/2014 Jackson
8,826,474 B2 9/2014 Jackson
8,826,475 B2 9/2014 Jackson
8,839,471 B2 9/2014 Jackson
8,844,077 B2 9/2014 Jackson et al.
8,856,986 B2 10/2014 Jackson
D720,076 S 12/2014 Sharps et al.
8,938,826 B2 1/2015 Jackson
8,978,180 B2 3/2015 Jackson
9,180,062 B2 11/2015 Jackson
9,186,291 B2 11/2015 Jackson et al.
9,198,817 B2 12/2015 Jackson
9,205,013 B2 12/2015 Jackson
9,211,223 B2 12/2015 Jackson
9,226,865 B2 1/2016 Jackson et al.
9,265,679 B2 2/2016 Jackson
9,265,680 B2 2/2016 Sharps et al.
9,289,342 B2 3/2016 Jackson
9,295,433 B2 3/2016 Jackson et al.
9,301,897 B2 4/2016 Jackson
9,308,145 B2 4/2016 Jackson
9,339,430 B2 5/2016 Jackson et al.
9,358,170 B2 6/2016 Jackson
9,364,380 B2 6/2016 Jackson
9,402,775 B2 8/2016 Jackson et al.
9,414,982 B2 8/2016 Jackson
9,456,945 B2 10/2016 Jackson
9,468,576 B2 10/2016 Jackson
9,504,622 B2 11/2016 Jackson
9,510,987 B2 12/2016 Jackson et al.
9,549,863 B2 1/2017 Jackson et al.
9,561,145 B2 2/2017 Jackson et al.
9,572,734 B2 2/2017 Jackson et al.
9,610,206 B2 4/2017 Jackson
9,622,928 B2 4/2017 Jackson et al.
2001/0037524 A1 11/2001 Truwit
2002/0170116 A1 11/2002 Borders et al.
2003/0074735 A1 4/2003 Zachrisson
2003/0145383 A1 8/2003 Schwaegerle
2004/0098804 A1 5/2004 Varadharajulu et al.
2004/0133983 A1 7/2004 Newkirk et al.
2004/0168253 A1 9/2004 Hand et al.
2004/0219002 A1 11/2004 Lenaers
2006/0185091 A1 * 8/2006 Jackson ..... A61G 13/0036 5/621
2006/0248650 A1 * 11/2006 Skripps ..... A61G 13/04 5/621
2007/0056105 A1 3/2007 Hyre et al.
2007/0107126 A1 5/2007 Koch et al.
2007/0157385 A1 7/2007 Lemire et al.
2007/0174965 A1 8/2007 Lemire et al.
2007/0266516 A1 11/2007 Cakmak
2008/0216241 A1 9/2008 Mangiardi

(56) References Cited

U.S. PATENT DOCUMENTS

| | | | | |
|---|---|---|---|---|
| 2009/0126116 | A1* | 5/2009 | Lamb | A61G 13/08 5/619 |
| 2009/0235456 | A1 | 9/2009 | Bock | |
| 2010/0037397 | A1 | 2/2010 | Wood | |
| 2010/0107790 | A1 | 5/2010 | Yamaguchi | |
| 2010/0192300 | A1* | 8/2010 | Tannoury | A61G 13/0036 5/607 |
| 2010/0223728 | A1 | 9/2010 | Hutchison et al. | |
| 2011/0083273 | A1* | 4/2011 | Sharps | A61G 13/02 5/624 |
| 2011/0107516 | A1* | 5/2011 | Jackson | A61G 13/04 5/608 |
| 2011/0107517 | A1 | 5/2011 | Lamb et al. | |
| 2011/0197361 | A1 | 8/2011 | Hornbach et al. | |
| 2012/0005832 | A1 | 1/2012 | Turner et al. | |
| 2012/0144589 | A1* | 6/2012 | Skripps | A61G 13/04 5/624 |
| 2012/0174319 | A1 | 7/2012 | Menkedick | |
| 2012/0246829 | A1 | 10/2012 | Lamb et al. | |
| 2012/0246830 | A1 | 10/2012 | Hornbach | |
| 2012/0255122 | A1* | 10/2012 | Diel | A61G 13/0036 5/610 |
| 2013/0111666 | A1 | 5/2013 | Jackson | |
| 2013/0133137 | A1 | 5/2013 | Jackson | |
| 2013/0269710 | A1 | 10/2013 | Hight et al. | |
| 2013/0282234 | A1 | 10/2013 | Roberts et al. | |
| 2013/0312188 | A1 | 11/2013 | Jackson | |
| 2014/0068861 | A1 | 3/2014 | Jackson et al. | |
| 2014/0201914 | A1 | 7/2014 | Jackson | |
| 2014/0208512 | A1 | 7/2014 | Jackson | |
| 2014/0317847 | A1 | 10/2014 | Jackson | |
| 2015/0007391 | A1 | 1/2015 | Xu | |
| 2015/0059094 | A1 | 3/2015 | Jackson | |
| 2015/0113733 | A1* | 4/2015 | Diel | A61G 13/04 5/610 |
| 2015/0150743 | A1 | 6/2015 | Jackson | |
| 2016/0000620 | A1 | 1/2016 | Koch | |
| 2016/0000621 | A1 | 1/2016 | Jackson et al. | |
| 2016/0000626 | A1 | 1/2016 | Jackson et al. | |
| 2016/0000627 | A1 | 1/2016 | Jackson et al. | |
| 2016/0000629 | A1 | 1/2016 | Jackson et al. | |
| 2016/0008201 | A1 | 1/2016 | Jackson | |
| 2016/0038364 | A1 | 2/2016 | Jackson | |
| 2016/0136027 | A1 | 5/2016 | Jackson | |
| 2016/0166452 | A1 | 6/2016 | Jackson et al. | |
| 2016/0213542 | A1 | 7/2016 | Jackson | |
| 2016/0296395 | A1 | 10/2016 | Jackson et al. | |
| 2016/0317372 | A1 | 11/2016 | Jackson | |
| 2016/0317373 | A1 | 11/2016 | Jackson et al. | |
| 2016/0346148 | A1 | 12/2016 | Jackson et al. | |
| 2016/0346149 | A1 | 12/2016 | Jackson et al. | |
| 2017/0071809 | A1 | 3/2017 | Jackson et al. | |

FOREIGN PATENT DOCUMENTS

| | | | |
|---|---|---|---|
| GB | 569758 | | 6/1945 |
| GB | 810956 | | 3/1959 |
| JP | S53763 | | 1/1978 |
| JP | 2000-060995 | | 2/2000 |
| JP | 2000-116733 | | 4/2000 |
| WO | WO99/07320 | | 2/1999 |
| WO | WO 00/07537 | | 2/2000 |
| WO | WO2000/062731 | | 10/2000 |
| WO | WO2001/060308 | | 8/2001 |
| WO | WO 02/078589 | A1 | 10/2002 |
| WO | WO2003/070145 | | 8/2003 |
| WO | WO 2007/130679 | A2 | 11/2007 |
| WO | WO2009/054969 | | 4/2009 |
| WO | WO2009/100692 | | 8/2009 |
| WO | WO2010/051303 | A1 | 5/2010 |

OTHER PUBLICATIONS

Complaint for Patent Infringement, *Jackson* v. *Mizuho Orthopedic Sys., Inc.*, No. 4:12-CV-01031 (W.D. Mo. Aug. 7, 2012).

First Amended Complaint for Patent Infringement and Correction of Inventorship, *Jackson* v. *Mizuho Orthopedic Sys., Inc.*, No. 4:12-CV-01031 (W.D. Mo. Sep. 21, 2012).

Defendant Mizuho Orthopedic Systems, Inc.'s Answer to First Amended Complaint and Counterclaims, *Jackson* v. *Mizuho Orthopedic Sys., Inc.*, No. 4:12-CV-01031 (W.D. Mo. Nov. 1, 2012).

Plaintiff Roger P. Jackson, MD's, Reply to Counterclaims, *Jackson* v. *Mizuho Orthopedic Sys., Inc.*, No. 4:12-CV-01031 (W.D. Mo. Nov. 26, 2012).

Roger P. Jackson's Disclosure of Asserted Claims and Preliminary Infringement Contentions, *Jackson* v. *Mizuho Orthopedic Sys., Inc.*, No. 4:12-CV-01031 (W.D. Mo. Jan. 4, 2013).

Second Amended Complaint for Patent Infringement, for Correction of Inventorship, for Breach of a Non-Disclosure and Confidentiality Agreement, and for Misappropriation of Dr. Jackson's Right of Publicity, *Jackson* v. *Mizuho Orthopedic Sys., Inc.*, No. 4:12-CV-01031 (W.D. Mo. Jan. 28, 2013).

Defendant Mizuho Orthopedic Systems, Inc.'s Answer to Second Amended Complaint and Counterclaims, *Jackson* v. *Mizuho Orthopedic Sys., Inc.*, No. 4:12-CV-01031 (W.D. Mo. Feb. 19, 2013).

Defendant Mizuho Osi's Invalidity Contentions Pursuant to the Parties' Joint Scheduling Order, *Jackson* v. *Mizuho Orthopedic Sys., Inc.*, No. 4:12-CV-01031 (W.D. Mo. Feb. 22, 2013).

Plaintiff Roger P. Jackson, MD's, Reply to Second Counterclaims, *Jackson* v. *Mizuho Orthopedic Sys., Inc.*, No. 4:12-CV-01031 (W.D. Mo. Mar. 12, 2013).

Roger P. Jackson, MD's Disclosure of Proposed Terms to Be Construed, *Jackson* v. *Mizuho Orthopedic Sys., Inc.*, No. 4:12-CV-01031 (W.D. Mo. Apr. 5, 2013).

Defendant Mizuho Orthopedic Systems, Inc.'s Disclosure of Proposed Terms and Claim Elements for Construction, *Jackson* v. *Mizuho Orthopedic Sys., Inc.*, No. 4:12-CV-01031 (W.D. Mo. Apr. 5, 2013).

Mizuho Orthopedic Systems, Inc.'s Disclosure of Proposed Claim Constructions and Extrinsic Evidence, *Jackson* v. *Mizuho Orthopedic Sys., Inc.*, No. 4:12-CV-01031 (W.D. Mo. May 13, 2013).

Plaintiff Roger P. Jackson, MD's Disclosure of Preliminary Proposed Claim Constructions, *Jackson* v. *Mizuho Orthopedic Sys., Inc.*, No. 4:12-CV-01031 (W.D. Mo. May 13, 2013).

Defendant Mizuho Osi's Amended Invalidity Contentions Pursuant to the Parties' Joint Scheduling Order, *Jackson* v. *Mizuho Orthopedic Sys., Inc.*, No. 4:12-CV-01031 (W.D. Mo. May 15, 2013).

Joint Claim Construction Chart and Joint Prehearing Statement, *Jackson* v. *Mizuho Orthopedic Sys., Inc.*, No. 4:12-CV-01031 (W.D. Mo. Jun. 7, 2013).

Defendant Mizuho Orthopedic Systems, Inc.'s Objections and Responses to Plaintiff's First Set of Interrogatories, *Jackson* v. *Mizuho Orthopedic Sys., Inc.*, No. 4:12-CV-01031 (W.D. Mo. Jun. 24, 2013).

Defendant Mizuho Orthopedic Systems, Inc.'s Opening Claim Construction Brief, *Jackson* v. *Mizuho Orthopedic Sys., Inc.*, No. 4:12-CV-01031 (W.D. Mo. Jul. 31, 2013).

Plaintiff Roger P. Jackson, MD's Opening Claim Construction Brief, *Jackson* v. *Mizuho Orthopedic Sys., Inc.*, No. 4:12-CV-01031 (W.D. Mo. Jul. 31, 2013).

Appendix A Amended Infringement Contentions Claim Chart for Mizuho's Axis System Compared to U.S. Pat. No. 7,565,708, *Jackson* v. *Mizuho Orthopedic Sys., Inc.*, No. 4:12-CV-01031 (W.D. Mo. Aug. 12, 2013).

Appendix B Amended Infringement Contentions Claim Chart for Mizuho's Axis System Compared to U.S. Pat. No. 8,060,960, *Jackson* v. *Mizuho Orthopedic Sys., Inc.*, No. 4:12-CV-01031 (W.D. Mo. Aug. 12, 2013).

Appendix C Amended Infringement Contentions Claim Chart for Mizuho's Proaxis System Compared to U.S. Pat. No. 7,565,708, *Jackson* v. *Mizuho Orthopedic Sys., Inc.*, No. 4:12-CV-01031 (W.D. Mo. Aug. 12, 2013).

Appendix D Amended Infringement Contentions Claim Chart for Mizuho's Proaxis System Compared to U.S. Pat. No. 8,060,960, *Jackson* v. *Mizuho Orthopedic Sys., Inc.*, No. 4:12-CV-01031 (W.D. Mo. Aug. 12, 2013).

(56) References Cited

OTHER PUBLICATIONS

Plaintiff Roger P. Jackson, MD's Responsive Claim Construction Brief, *Jackson* v. *Mizuho Orthopedic Sys., Inc.*, No. 4:12-CV-01031 (W.D. Mo. Aug. 16, 2013).
Defendant Mizuho Orthopedic Systems, Inc's Brief in Response to Plaintiff's Opening Claim Construction Brief, *Jackson* v. *Mizuho Orthopedic Sys., Inc.*, No. 4:12-CV-01031 (W.D. Mo. Aug. 16, 2013).
Plaintiff Roger P. Jackson, MD's Suggestions in Support of His Motion to Strike Exhibit A of Mizuho's Opening Claim Construction Brief, *Jackson* v. *Mizuho Orthopedic Sys., Inc.*, No. 4:12-CV-01031 (W.D. Mo. Aug. 16, 2013).
Defendant Mizuho Orthopedic Systems, Inc.'s Opposition to Plaintiff's Motion to Strike, *Jackson* v. *Mizuho Orthopedic Sys., Inc.*, No. 4:12-CV-01031 (W.D. Mo. Sep. 3, 2013).
Transcript of Claim Construction Hearing, *Jackson* v. *Mizuho Orthopedic Sys., Inc.*, No. 4:12-CV-01031 (W.D. Mo. Oct. 11, 2013).
Plaintiff Roger P. Jackson, MD's Claim Construction Presentation for U.S. District Judge Nanette K. Laughrey, *Jackson* v. *Mizuho Orthopedic Sys., Inc.*, No. 4:12-CV-01031 (W.D. Mo. Oct. 11, 2013).
Mizuho's Claim Construction Argument, *Jackson* v. *Mizuho Orthopedic Sys., Inc.*, No. 4:12-CV-01031 (W.D. Mo. Oct. 11, 2013).
Order, *Jackson* v. *Mizuho Orthopedic Sys., Inc.*, No. 4:12-CV-01031 (W.D. Mo. Apr. 4, 2014).
Brochure of OSI on Modular Table System 90D, pp. 1-15, date of first publication: Unknown.
Pages from website http://www.schaerermayfieldusa.com, pp. 1-5, date of first publication: Unknown.
European Search Report, EP11798501.0, dated Mar. 30, 2015.
Canadian Office Action, CA2803110, dated Mar. 5, 2015.
Chinese Office Action, CN 201180039162.0, dated Jan. 19, 2015.
Japanese Office Action, JP 2014-142074, dated Jun. 18, 2015.
Japanese Office Action, JP 2014-132463, dated Jun. 18, 2015.
Quayle Action, U.S. Appl. No. 14/792,216, dated Sep. 9, 2015.
Australian Patent Examination Report No. 2, AU2014200274, dated Oct. 9, 2015.
European Examination Report, EP11798501.0, dated Nov. 12, 2015.
Japanese Final Rejection (English version), JP 2014-142074, dated Dec. 6, 2015.
International Search Report and Written Opinion of the International Searching Authority, PCT/US2015/039400, dated Dec. 7, 2015, 13 pages.
Japanese Office Action, JP 2016-041088, dated Apr. 12, 2016.
U.S. Appl. No. 15/421,994, filed Feb. 1, 2017, Jackson et al.
U.S. Appl. No. 15/431,439, filed Feb. 13, 2017, Jackson.
U.S. Appl. No. 15/465,289, filed Mar. 21, 2017, Jackson et al.
U.S. Appl. No. 15/479,007, filed Apr. 4, 2017, Jackson.
U.S. Appl. No. 15/483,063, filed Apr. 10, 2017, Jackson et al.
U.S. Appl. No. 15/631,911, filed Jun. 23, 2017, Jackson.
U.S. Appl. No. 15/660,336, filed Jul. 26, 2017, Jackson.

* cited by examiner

PATIENT SUPPORT APPARATUS WITH BODY SLIDE POSITION DIGITALLY COORDINATED WITH HINGE ANGLE

CROSS-REFERENCE TO RELATED APPLICATIONS

This application is a continuation of U.S. patent application Ser. No. 13/956,728, filed Aug. 1, 2013. Application Ser. No. 13/956,728 claims the benefit of U.S. Provisional Application No. 61/742,098 filed Aug. 2, 2012; U.S. Provisional Application No. 61/743,240 filed Aug. 29, 2012; U.S. Provisional Application No. 61/849,035 filed Jan. 17, 2013; U.S. Provisional Application No. 61/795,649 filed Oct. 22, 2012; U.S. Provisional Application No. 61/849,016 filed Jan. 17, 2013; and U.S. Provisional Application No. 61/852,199 filed Mar. 15, 2013, the entirety of which are incorporated by reference herein.

Application Ser. No. 13/956,728 is a continuation-in-part of U.S. patent application Ser. No. 13/986,060 filed Mar. 14, 2013; which is a continuation-in-part of U.S. patent application Ser. No. 12/803,192 filed Jun. 21, 2010, now U.S. Pat. No. 9,186,291, the entirety of which are incorporated by reference herein.

Application Ser. No. 13/956,728 is also a continuation-in-part of U.S. patent application Ser. No. 13/374,034 filed Dec. 8, 2011, now U.S. Pat. No. 9,308,145, which claims the benefit of U.S. Provisional Application No. 61/459,264 filed Dec. 9, 2010, and which is also a continuation-in-part of U.S. patent application Ser. No. 12/460,702 filed Jul. 23, 2009 now U.S. Pat. No. 8,060,960; and which was a continuation of U.S. patent application Ser. No. 11/788,513 filed Apr. 20, 2007 and now U.S. Pat. No. 7,565,708, the entirety of which are incorporated by reference herein.

Application Ser. No. 13/956,728 is also a continuation-in-part of U.S. patent application Ser. No. 13/694,392 filed Nov. 28, 2012; which claims the benefit of U.S. Provisional Application No. 61/629,815 filed Nov. 28, 2011, the entirety of which are incorporated by reference herein.

BACKGROUND OF THE INVENTION

The present invention is directed to structure for use in maintaining a patient in a desired position during examination and treatment, including medical procedures such as imaging and surgery. In particular, the present invention is directed to such a structure that allows a surgeon to selectively position the patient for convenient access to the surgery site and that provides for manipulation of the patient during surgery including digitally coordinated tilting, pivoting, and angulating or bending of a trunk and/or a joint of a patient in a supine, prone, or lateral position.

Current surgical practice incorporates imaging techniques and technologies throughout the course of patient examination, diagnosis, and treatment. For example, minimally invasive surgical techniques, such as percutaneous insertion of spinal implants, involve small incisions that are guided by continuous or repeated intra-operative imaging. These images can be processed using computer software that produces three dimensional images for reference by the surgeon during the course of the procedure. If the patient support surface is not radiolucent or compatible with the imaging technologies, it may be necessary to interrupt the surgery periodically in order to remove the patient to a separate surface for imaging followed by transfer back to the operating support surface for resumption of the surgical procedure. Such patient transfers for imaging purposes may be avoided by employing radiolucent and other imaging compatible patient support systems. The patient support system should be constructed to permit unobstructed movement of the imaging equipment and other surgical equipment around, over, and under the patient throughout the course of the surgical procedure without contamination of the sterile field.

It is also necessary that the patient support system be constructed to provide optimum access to the surgical field by the surgery team. Some procedures require positioning of portions of the patient's body in different ways at different times during the procedure. Some procedures, for example, spinal surgery, involve access through more than one surgical site or field. Since all of these fields may not be in the same plane or anatomical location, the patient support surfaces should be adjustable and capable of providing support in different planes for different parts of the patient's body as well as different positions or alignments for a given part of the body. The support surface should be adjustable to provide support in separate planes and in different alignments for the head and upper trunk portion of the patient's body, the lower trunk and pelvic portion of the body, as well as each of the limbs independently.

Certain types of surgery, such as orthopedic surgery, may require that the patient or a part of the patient be repositioned during the procedure while in some cases maintaining the sterile field. Where surgery is directed toward motion preservation procedures, such as by installation of artificial joints, spinal ligaments, and total disc prostheses, for example, the surgeon must be able to manipulate certain joints while supporting selected portions of the patient's body during surgery in order to facilitate the procedure. It is also desirable to be able to test the range of motion of the surgically repaired or stabilized joint and to observe the gliding movement of the reconstructed articulating prosthetic surfaces or the tension and flexibility of artificial ligaments, spacers, and other types of dynamic stabilizers before incisions are closed. Such manipulation can be used, for example, to verify the correct positioning and function of an implanted prosthetic disc, spinal dynamic longitudinal connecting member, interspinous spacer, or joint replacement during a surgical procedure. Where manipulation discloses binding, sub-optimal position, or even crushing of the adjacent vertebrae, for example, as may occur with osteoporosis, the prosthesis can be removed and the adjacent vertebrae fused while the patient remains anesthetized. Injury which might otherwise have resulted from a "trial" use of the implant post-operatively will be avoided, along with the need for a second round of anesthesia and surgery to remove the implant or prosthesis and perform the revision, fusion, or corrective surgery.

There is a need for a patient support surface that can be rotated, articulated, and angulated in a coordinated manner so that the patient can be moved from a prone to a supine position or from a prone to a 90° position and whereby intra-operative extension and flexion of at least a portion of the spinal column can be achieved. The patient support surface must also be capable of easy, selective, and coordinated adjustment without necessitating removal of the patient or causing substantial interruption of the procedure.

The patient support may be articulated upwardly and downwardly at the patient's hips during such a surgical procedure. Such patient support articulation results in an undesirable extension or compression, respectively, of at least a portion of the patient's body. Thus, there is a need for translation compensation of the extended or compressed portion of the patient's body that is coordinated with articulation of the patient support, so as to prevent such undesirable compression or extension. Such translation compensation can be provided by a slide mechanism supporting either an upper or lower portion of the patient's body, or both, which moves toward patient support articulation hinge when the patient support is articulated upwardly or away from the hinge when the patient support is articulated downwardly. The slide mechanism can be mechanically linked to the portions of the patient support so that the slide mechanism is moved in proportion to the hinge angle of the patient support. A disadvantage of a mechanically linked translation compensation mechanism is that the proportionality between the linear movement of the slide mechanism and the hinge angle is usually fixed.

For certain types of surgical procedures, for example spinal surgeries, it may be desirable to position the patient for sequential anterior and posterior procedures. The patient support surface should also be capable of rotation about an axis in order to provide correct positioning of the patient and optimum accessibility for the surgeon as well as imaging equipment during such sequential procedures.

Orthopedic procedures may require the use of traction equipment such as cables, tongs, pulleys, and weights. The patient support system must include structure for anchoring such equipment, and it must provide adequate support to withstand unequal forces generated by traction against such equipment.

Articulated robotic arms are increasingly employed to perform surgical techniques. These units are generally designed to move short distances and to perform very precise work. Reliance on the patient support structure to perform any necessary gross movement of the patient can be beneficial, especially if the movements are synchronized or coordinated. Such units require a surgical support surface capable of smoothly performing the multi-directional movements which would otherwise be performed by trained medical personnel. There is, thus, a need for integration between the robotics technology and the patient positioning technology.

While conventional operating tables generally include structure that permits tilting or rotation of a patient support surface about a longitudinal axis, previous surgical support devices have attempted to address the need for access by providing a cantilevered patient support surface on one end. Such designs typically employ either a massive base to counterbalance the extended support member or a large overhead frame structure to provide support from above. The enlarged base members associated with such cantilever designs are problematic in that they can and do obstruct the movement of C-arm and O-arm mobile fluoroscopic imaging devices and other equipment. Surgical tables with overhead frame structures are bulky and may require the use of dedicated operating rooms, since in some cases they cannot be moved easily out of the way. Neither of these designs is easily portable or storable.

Thus, there remains a need for a patient support system that provides easy access for personnel and equipment, that can be easily and quickly positioned and repositioned in multiple planes without the use of massive counterbalancing support structure, and that does not require use of a dedicated operating room.

SUMMARY OF THE INVENTION

The present invention is directed to embodiments of a patient support apparatus having a hinged or articulated patient support assembly and a translation compensation mechanism which is digitally synchronized or coordinated with hinged articulation of the patient support assembly.

In an embodiment of the patient support apparatus, the patient support assembly includes two body support frames positioned in an angular relation therebetween and in relation to spaced apart end supports. At least one angle motor is engaged with at least one of the body support frames, and a body slide member is slidingly engaged with an associated body support frame and movable therealong by a slide motor. An angle encoder is engaged with the angle motor and/or the body support frames and generates an angle signal indicating an angular relationship between body support frames. A slide encoder is engaged with the slide motor or between the body slide member and the associated body support frame and generates a slide signal indicating a position of the slide member along the associated body support frame. A patient support controller or processor has the angle motor, the angle encoder, the slide motor, and the slide encoder interfaced thereto and operates to digitally coordinate positioning of the slide member along the associated support frame by the slide motor, as indicated by the slide signal, with variations of the angular relationships between the support frames by the angle motor, as indicated by the angle signal.

An embodiment of the patient support apparatus includes a support base including a head end support and a foot end support positioned in spaced relation to the head end support, an upper body support frame hingedly connected to the head end support, and a lower body support frame hingedly connected the foot end support and hingedly connected the upper body support frame to enable angular articulation between the support frames. A length compensator is engaged between an end of one of the support frames and its respective end support to thereby enable the angular articulation between the support frames and with the end supports. A body slide assembly including a body slide member engages one of the support frames in such a manner as to enable sliding movement on the associated support frame, and a body slide motor is engaged between the body slide member and the associated support frame with which the body slide member is slidingly engaged. The body slide assembly can be adapted either as an upper body slide assembly or a lower body slide assembly. A body slide position encoder is engaged between said body slide assembly and the associated support frame in such a manner as to generate a slide position signal indicating a position of the slide member along the associated support frame.

A hinge motor is engaged between the support frames at a hinge therebetween and is operable to vary an angular relationship between the support frames. A hinge angle encoder is engaged with said hinge motor in such a manner as to generate a hinge angle signal indicating the angular relationship between the support frames. A patient support controller or control computer has the slide motor, the slide position encoder, the hinge motor, and the hinge angle encoder interfaced thereto. The controller is operative to coordinate positioning of the slide member along the associated support frame by the slide motor, as indicated by the slide position signal, with variations of the angular relationship between the support frames by the hinge motor, as indicated by the hinge angle signal.

In an embodiment of the patient support apparatus, the upper and lower body support frames form a patient support assembly which extends between the head and foot end supports. The upper body support frame includes a pair of elongated, transversely spaced upper body members connected at a head end by a head crossbar. Similarly, the lower body support frame includes a pair of elongated, transversely spaced lower body members. Foot ends of the lower body members receive length compensators or translator rods which are connected by a foot crossbar. The translator rods reciprocate out of and into bushings positioned at foot ends of the lower body member to enable hinged articulation between the upper and lower body support frames. In an embodiment of the apparatus, the head crossbar is hingedly connected to a head ladder frame which is pivotally connected to the head end support for pivoting about a roll axis of the patient support assembly. The head end support has a roll motor mounted therein which has a roll motor shaft connected to the head ladder frame. The foot crossbar is hingedly connected to a foot ladder frame which is pivotally connected to the foot end support to cooperate with the roll motor in pivoting the patient support assembly about a roll axis.

The upper body members of an embodiment are hingedly connected respectively to the lower body members at body support hinges which are aligned with a body support hinge axis. Hinge motors are engaged respectively between the upper and lower body members to cause hinged articulation between the upper and lower body support frames. An embodiment of the patient support apparatus employs worm drive motor assemblies as the hinge motors. Each upper body member has a sector of a worm gear mounted at the hinge end thereof. Each motor assembly includes a motor mounted at the hinge end of one of the lower body members and has a worm on a shaft of the motor which meshes with the respective worm gear on the associated upper body member. Coordinated activation of the hinge motors causes hinged articulation of the upper and lower body frames about the hinge axis. Each of the hinge motors includes a hinge angle encoder which communicates a hinge angle signal to the patient support controller. The hinge motors may also be interfaced to the patient support controller to enable the coordinated operation thereof.

In an embodiment of the patient support apparatus, the head and foot end supports are connected by a rigid lower framework, which may include a single frame member. The head and foot end supports include end lift mechanisms to independently lift a head end of the patient support assembly and/or the lower end thereof. The head end support is provided with a single head lift mechanism. The foot end support is provided with a primary foot lift mechanism and a secondary foot lift mechanism to provide a greater range of travel of the foot end of the patient support assembly to nearly floor level. The head and foot lift mechanisms can be implemented as jack screw arrangements motorized by electric motors, or as pneumatic or hydraulic cylinder arrangements.

When a patient is supported on the patient support assembly, the assembly hinge axis is spaced below a bending axis of the patient when the patient support assembly is hinged up or down. As a result, hinged articulation of the support assembly upwardly tends to stretch the body of the patient while hinging the support assembly downwardly tends to compress the body of the patient. To prevent or relieve such stretching or compressing, it is necessary to reposition the patient or to provide a body slide mechanism which allows sliding of a part of the patient's body along the body support assembly to prevent stretching or compressing. Preferably, the components which allow a part of the body to slide are not simply passively sliding, since more precise positioning of the portions of the patient's body for surgical or imaging procedures is desirable. The body slide mechanism can support the upper body of the patient or the lower body, or body slide mechanisms can be provided for both the upper and lower body of the patient. The position of the body slide mechanism can be adjusted manually or movement of the body slide can be coordinated with pivoting movement of the upper and lower body support frames about the body support hinge axis.

In an embodiment of the patient support apparatus, an upper body slide assembly includes a pair of elongated upper body guide members which are adapted for removable placement on the upper body frame members. An upper body slide trolley or tray is slidably mounted on the guide members and is connected by upper body slide timing belts to an upper body slide motor engaged with drive pulleys supporting head ends of the timing belts, the opposite ends of which are supported by freewheeling pulleys. The upper body slide assembly may include cross members (not shown) extending between the guide members and between upper and lower runs of the timing belt to form a stable framework for the assembly. The trolley has a pair of elongated inner trolley guide members secured thereto which engage inboard sides of the upper body guide members and retain the trolley thereon and may also include outer trolley guide members which engage outboard sides of the upper body guide members. The trolley has a sternum pad mounted on a top surface thereof and may include other pads, such as a forehead pad, forearm pads, and the like to support portions of the upper body of the patient.

The upper body motor is secured to one of the upper body guide members and has a upper body motor shaft which extends between the drive pulleys and through the motor. The motor includes an upper body slide encoder which senses the relative position of the trolley along the upper body guides in relation to the hinge axis and communicates an upper body slide signal to the patient support controller. The upper body motor is interfaced to the patient support controller to enable activation of the motor by or through the controller and to enable coordination of the positioning of the upper body trolley with the hinge angle of the upper and lower body support frames.

In general, the upper body slide is moved toward the hinge axis when the patient support assembly is hinged upwardly and away from the hinge axis when the patient support assembly is hinged downwardly. The amount of linear movement of the upper body slide is proportioned to the hinge angle between the body support frames to avoid stretching or compression stresses in the patient's body as the patient support assembly is hinged. The linear to angular movement relationship can vary depending on the height, weight, girth, proportion of the upper body length to lower body length of the patient, and other factors. Such factors can be entered into the patient support controller to control the proportion of linear movement of the upper body slide assembly to the hinge angle.

In an embodiment of the patient support apparatus, a lower body side assembly is provided on the lower body support frame to avoid stretching or compressing the patient's body when the body support assembly is hinged up or down. The lower body slide assembly could be configured somewhat similar to the upper body slide assembly, with hip pads replacing the sternum pads.

In an embodiment of the patient support apparatus, each of the lower body frame members is provided with an associated lower body slide mechanism. The lower body slide mechanisms are operated in unison or in coordination with one another, as well as in coordination with the hinge motors. Each body slide mechanism includes a hip pad mounted on a hip pad bracket which engages a linear guide on the lower body frame member. A hip pad linear actuator is formed by a lower body slide motor turning a jack screw having a nut assembly thereon which is connected by an actuator rod to the hip pad bracket. The lower body slide motor and linear actuator are mounted on a lower side of the lower body frame member.

Each lower body slide motor includes a lower body slide encoder which generates a lower body slide signal which indicates the current position of the hip pad along the lower body frame member. The lower body slide motors and encoders are interfaced to the patient support controller to enable the motors to be operated in coordination with one another to move the hip pads in unison and to enable movement of the hip pads to be coordinated with angular articulation of the upper and lower body support frames.

Movement of the lower slide assemblies is proportional to the angular articulation of the upper and lower body support frames. Similar to the upper body slide assembly, the proportionality of movement can vary depending on the patient's height, weight, girth, proportion of the upper body length to lower body length, and other factors. Such factors can be entered into the patient support controller to control the proportion of linear movement of the lower body slide assemblies to the hinge angle.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE ILLUSTRATED EMBODIMENTS

Figure 1:
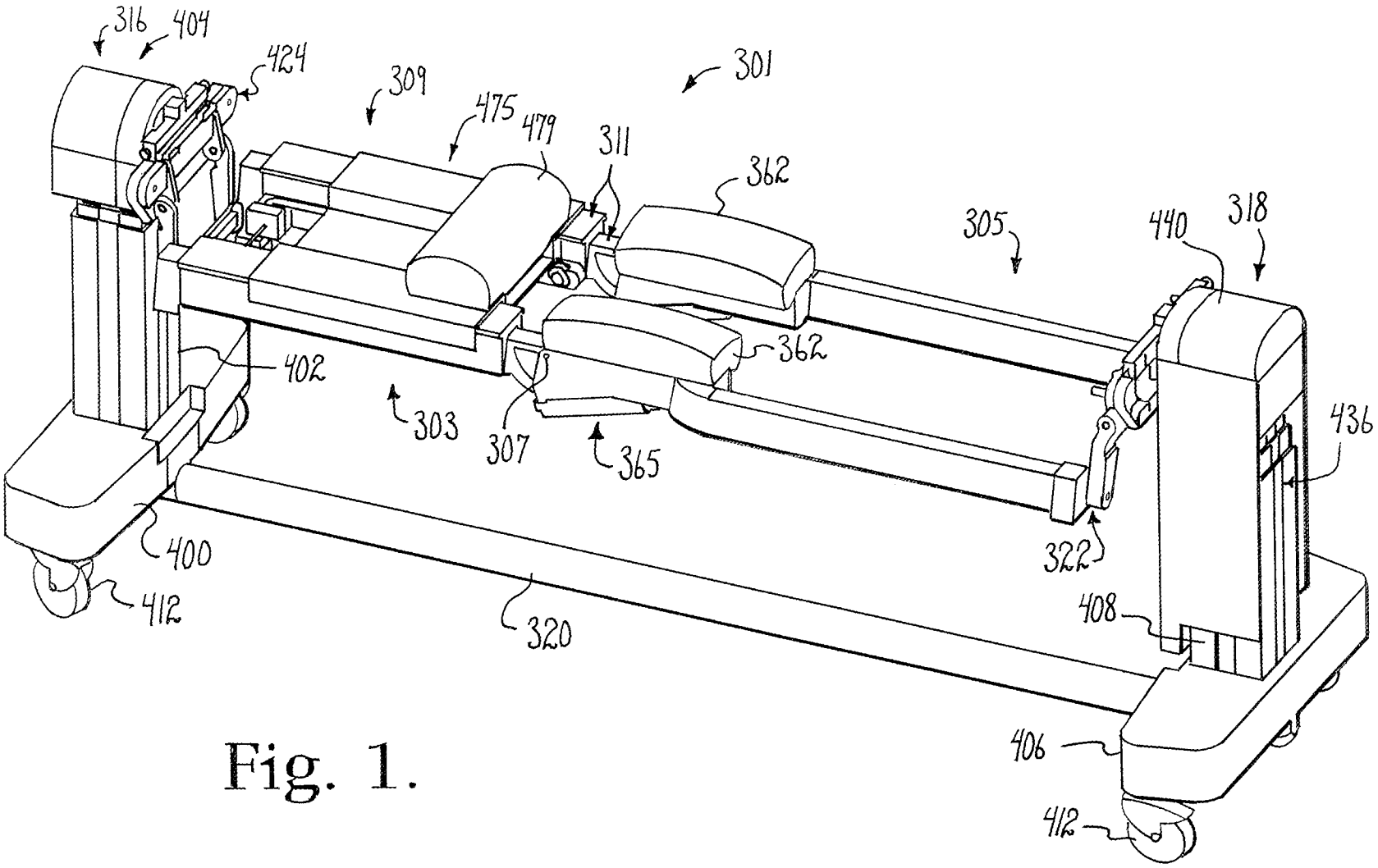
FIG. 1 is a perspective view of an embodiment of a patient support structure with a body slide position digitally coordinated with a hinge angle according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference number 301 generally designates a patient support structure with a body slide position digitally coordinated with a hinge angle, according to the present invention. The patient support structure 301 generally includes an upper body frame 303 and a lower body frame 305 which are hingedly connected at a support hinge 307 to enable hinged articulation therebetween. A body slide assembly 309 is engaged with one of the body frames 303 or 305, such as the upper body frame 303, to avoid stretching or compressing the body of a patient on the support structure during articulation of the upper and lower body support frames 303 and 305 about hinge 307. Linear movement of the body slide assembly 309 is digitally coordinated with the angle of articulation of the frames 303 and 305 about the hinge 307.

The body support frames 303 and 305 form a patient support assembly 311, with the upper body support frame 303 being hingedly connected to a head end support assembly 316 and the lower body support frame 305 hingedly connected to a foot end support assembly 318. The illustrated end support assemblies 316 and 318 are connected in fixed relation by an elongated center beam 320. One end of the patient support assembly 311 includes a length compensator mechanism 322, such as at a foot end of the lower body support frame 305, to enable the patient support assembly 311 to lengthen when the body support frames 303 and 305 are hingedly articulated.

Figure 3:
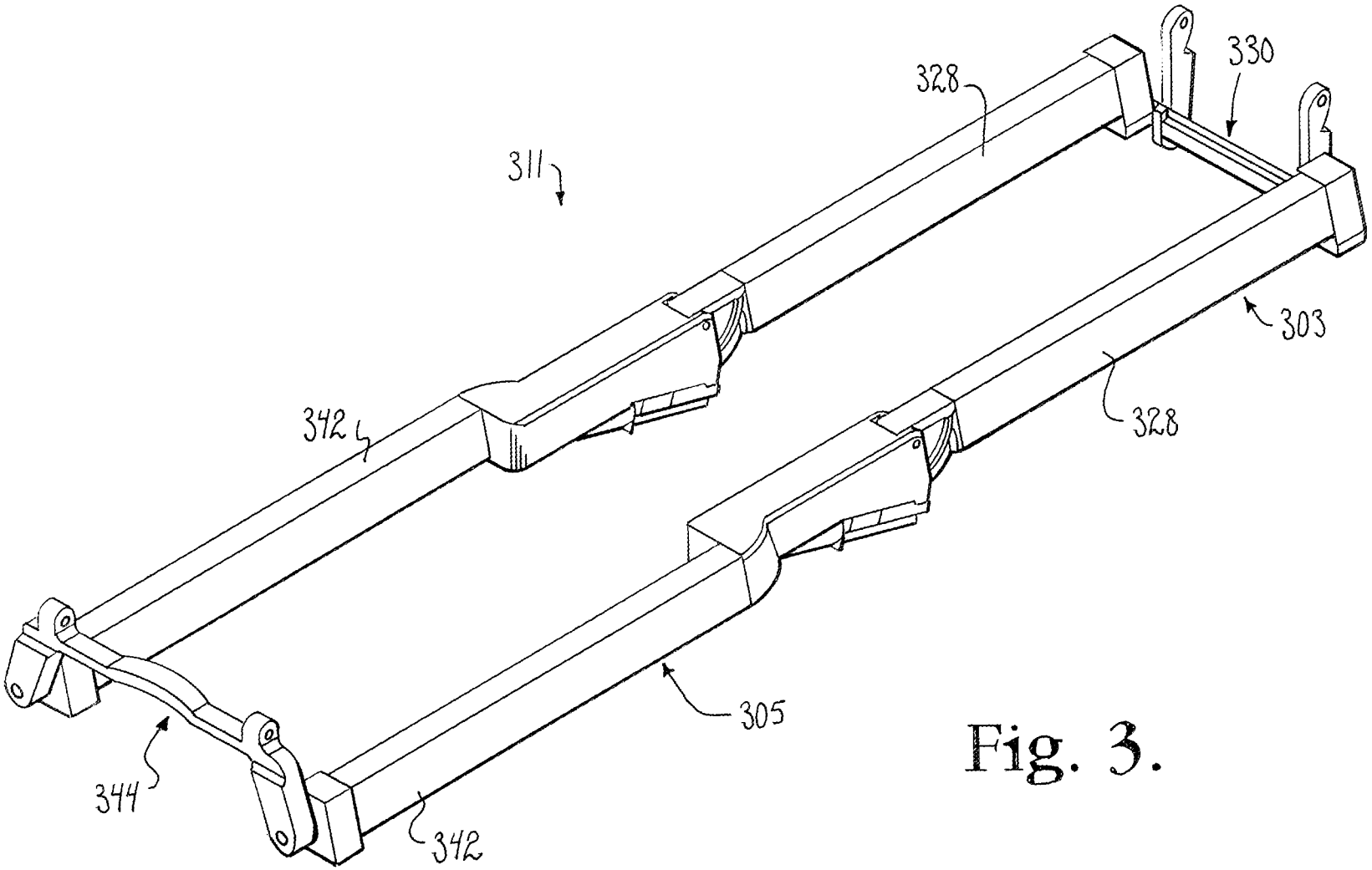
FIG. 3 is a perspective view of the body support frames of the patient support structure at a reduced scale.
Figure 4:
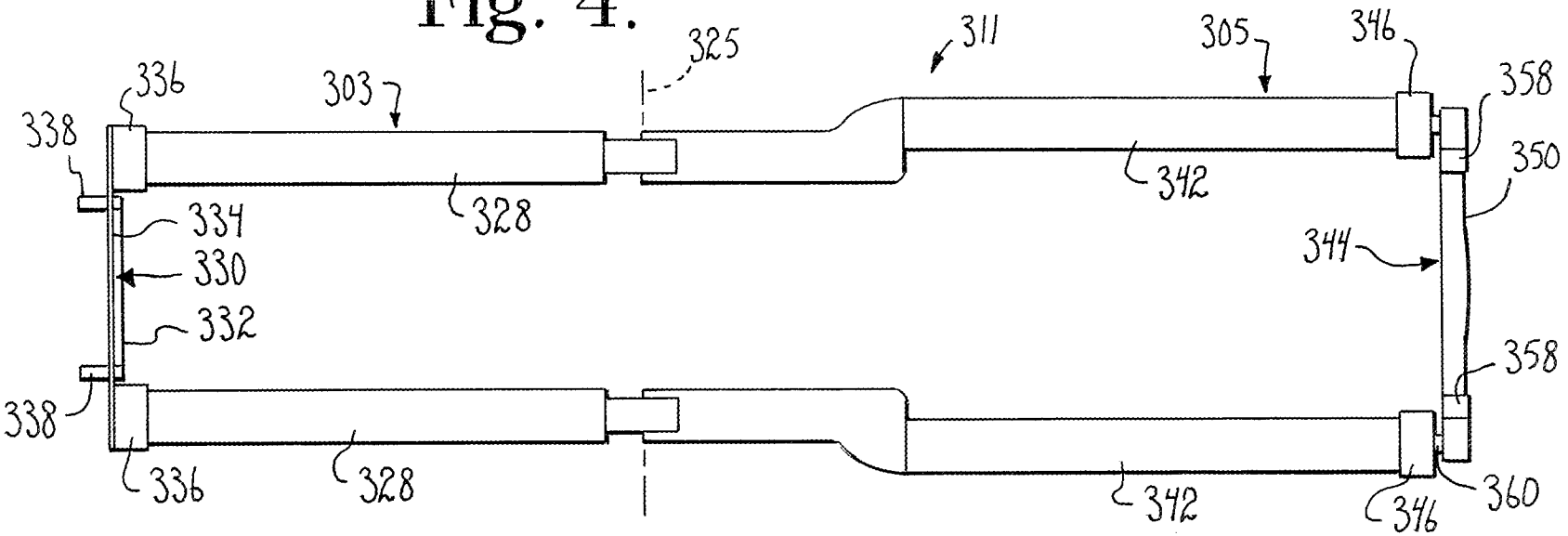
FIG. 4 is a top plan view of the body support frames.
Figure 5:
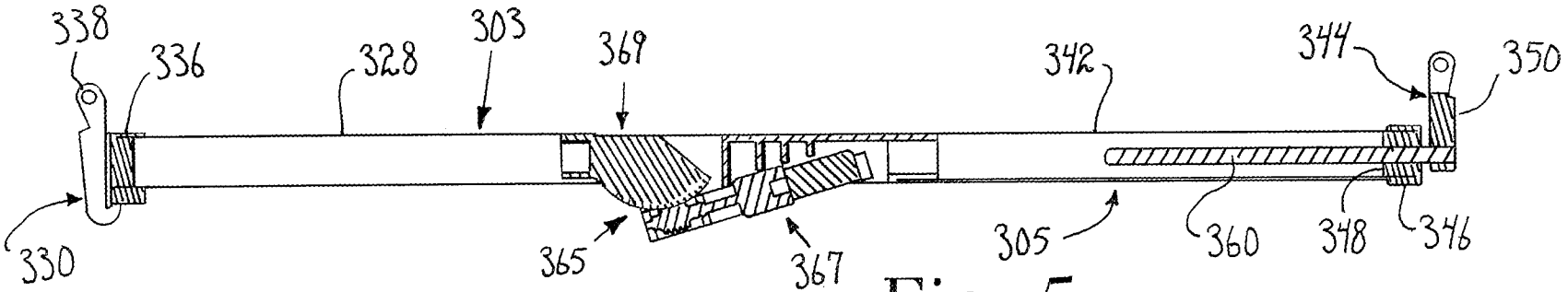
FIG. 5 is a longitudinal sectional view of components of the body support frames taken along line 5-5 of FIG. 4 and illustrate hinge articulation and length compensation details thereof.
Figure 15:
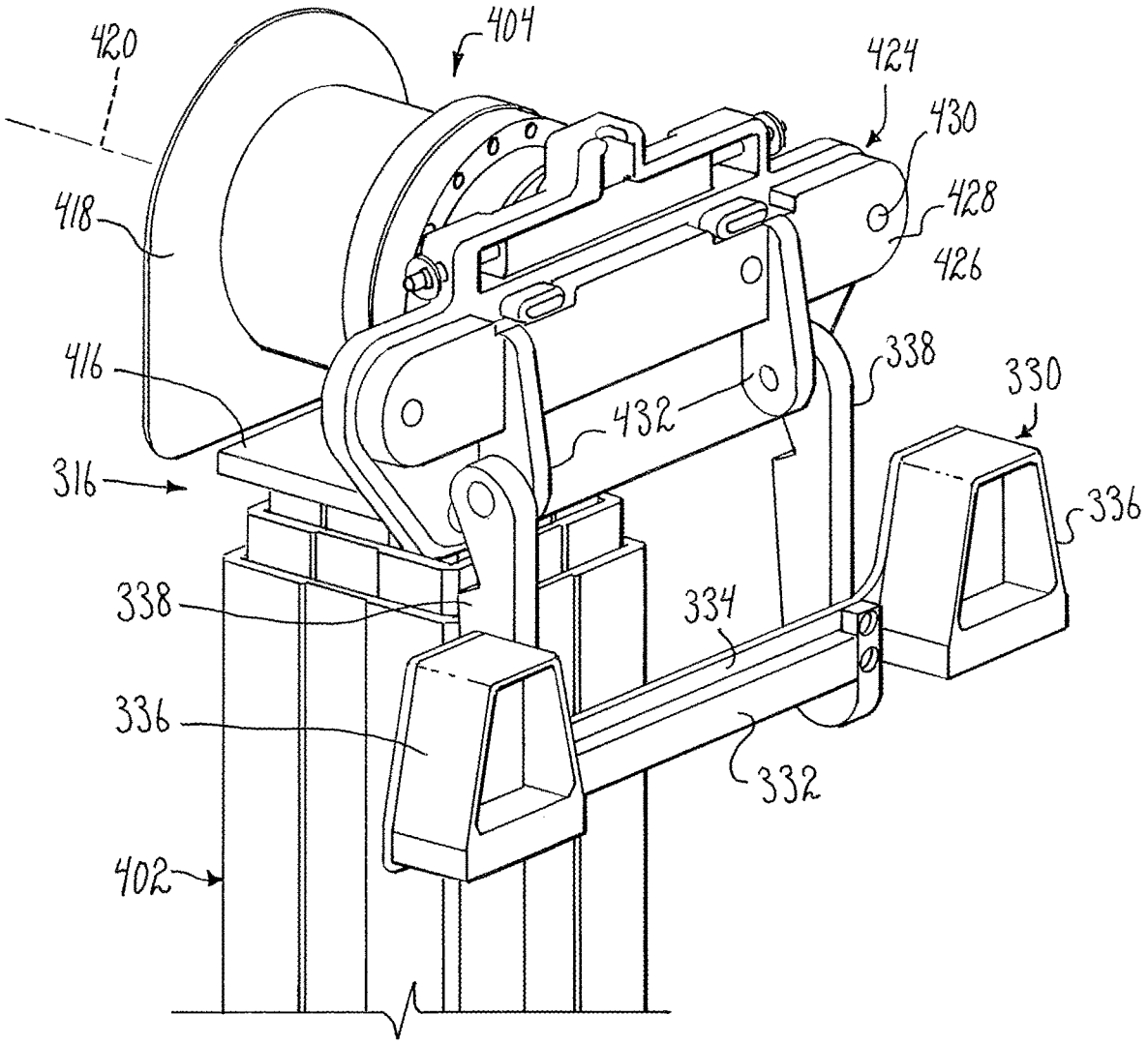
FIG. 15 is an enlarged fragmentary perspective view of a head end support of the patient support structure with portions broken away to illustrate details of a roll motor thereof.
Figure 16:
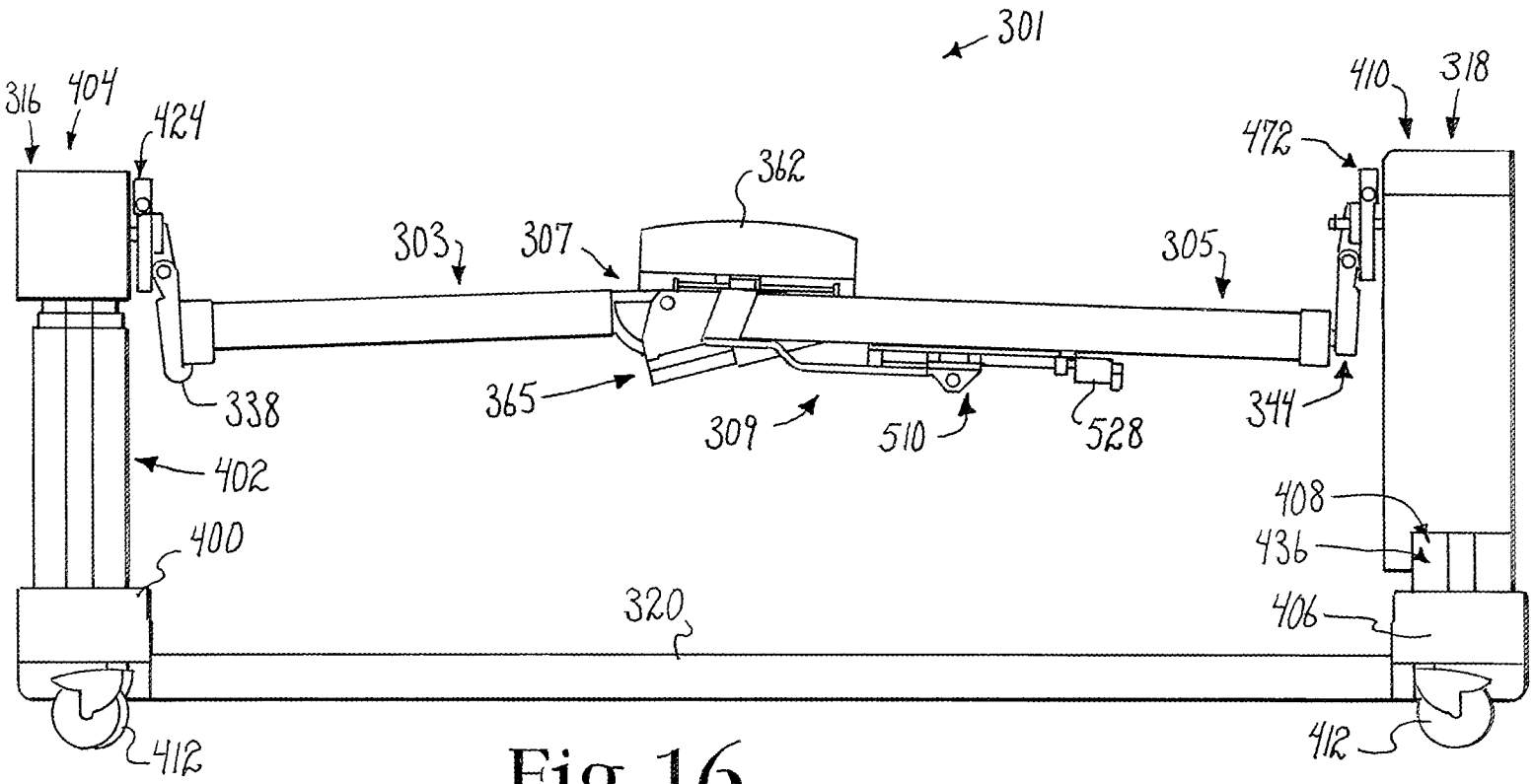
FIG. 16 is a side elevational view of a modified embodiment of the patient support structure having a lower body slide mechanism digitally coordinated with an angle of the hinge.
Figure 17:
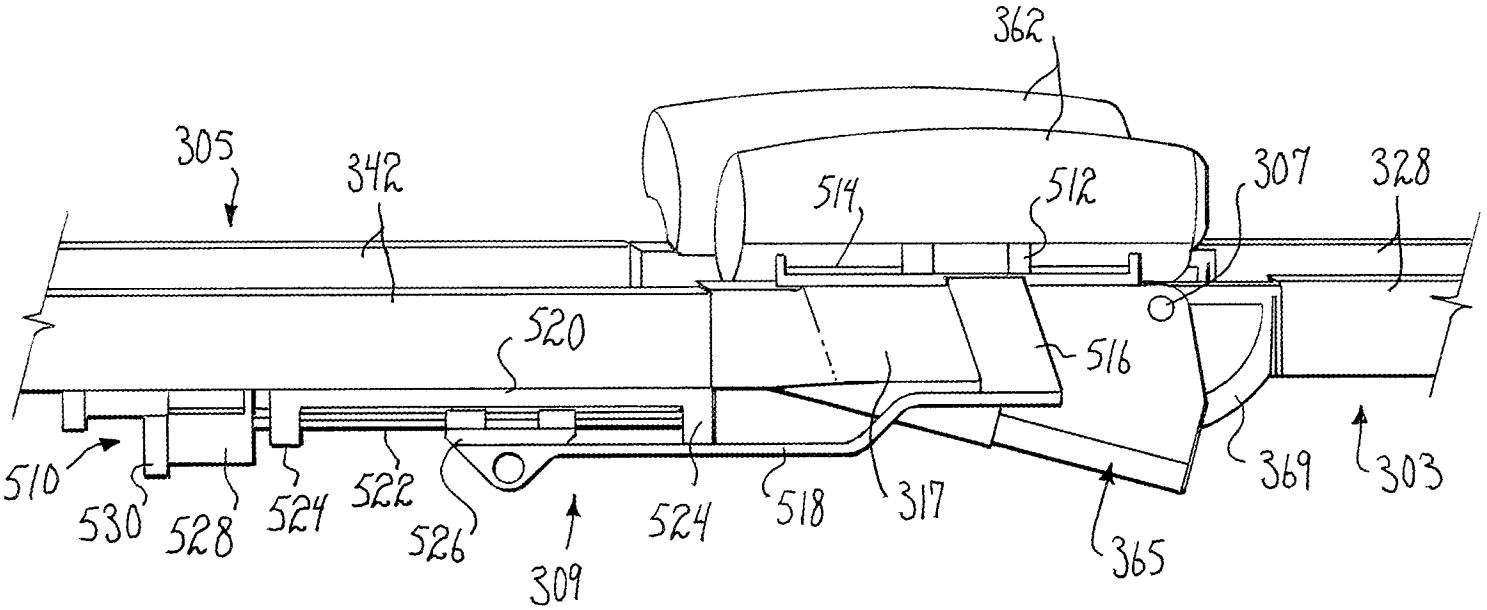
FIG. 17 is an enlarged fragmentary side elevational view of the modified patient support structure with body support frames in a hinge-neutral relationship.

Referring to FIGS. 3-5, the illustrated patient support assembly 311 includes the upper and lower body support frames 303 and 305 which are pivotally connected at the hinge, or as illustrated hinges, 307 having aligned hinge axes 325. The illustrated upper body support frame 303 includes a pair of spaced apart elongated upper body support members 328 which are interconnected in parallel relation at a head end by a head crossbar assembly 330. Referring to FIG. 15, the illustrated head crossbar assembly includes a head crossbar 332 and a head crossbar plate 334. The head crossbar plate 334 interconnects a pair of transversely spaced head end caps 336 and is reinforced by the head crossbar 332. Head ends of the upper body support members 328 are receive in and secured to the head end caps 336. The head crossbar assembly 330 includes a pair of spaced apart head end hinge brackets 338 which are secured to the head crossbar 332 and the head crossbar plate 334. The head end hinge brackets 338 hingedly connect with structure on the head end support assembly, as will be described further below.

Figure 13:
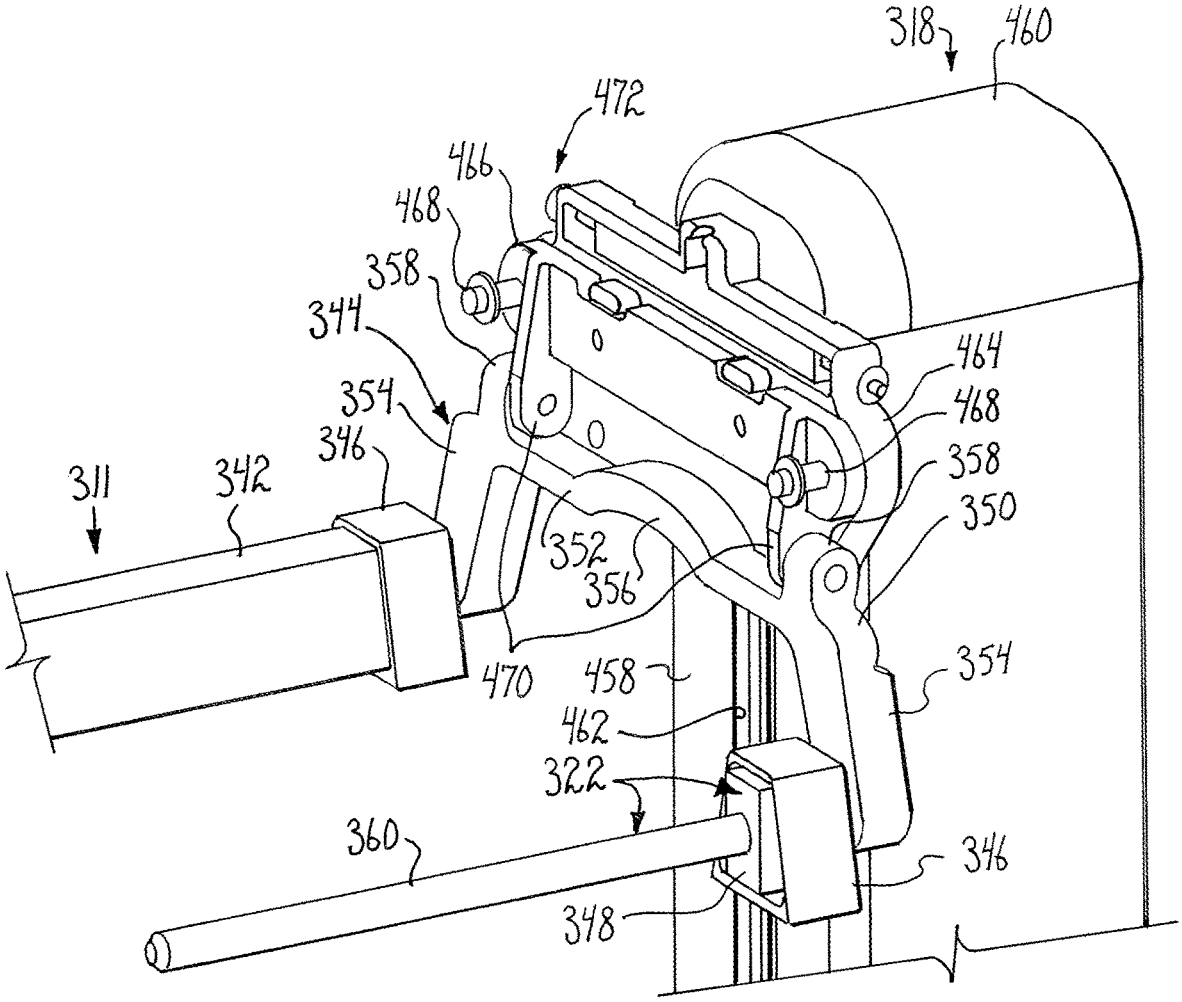
FIG. 13 is an enlarged fragmentary perspective view of a foot end of the patient support structure with a portion of a lower body support frame member removed to illustrate a length compensation rod thereof.

The illustrated lower body frame 305 includes a pair of elongated lower body support members 342 connected in spaced apart parallel relation by a foot crossbar assembly 344. Referring to FIG. 13, foot ends of the lower body support members 342 are closed by foot end caps 346 to which the members 342 are secured. The end caps 346 have bushing members 348 secured thereto. The illustrated foot crossbar assembly 344 includes an inverted U-shaped foot crossbar member 350 having transverse strut 352 and a pair of rod support legs 354 depending in an outward angular orientation therefrom. The transverse strut 352 may have an upwardly arched center section or arch 356 to provide clearance of the center beam 320 when a foot end of the patient support assembly 311 is lowered to its lower extreme. The crossbar member 350 has a pair of transversely spaced hinge lugs 358 extending upwardly from outer ends thereof. Each of the rod support legs 354 has an elongated translator rod 360 extending therefrom. The rods 360 are slidably received in the bushings 348 and form the length compensators 322 therewith. The illustrated lower body frame 305 may be provided with hip pads 362 secured in transverse spaced relation to the lower body support members 342 to support hip and thigh areas of a patient positioned on the patient support assembly 311.

Figure 6:
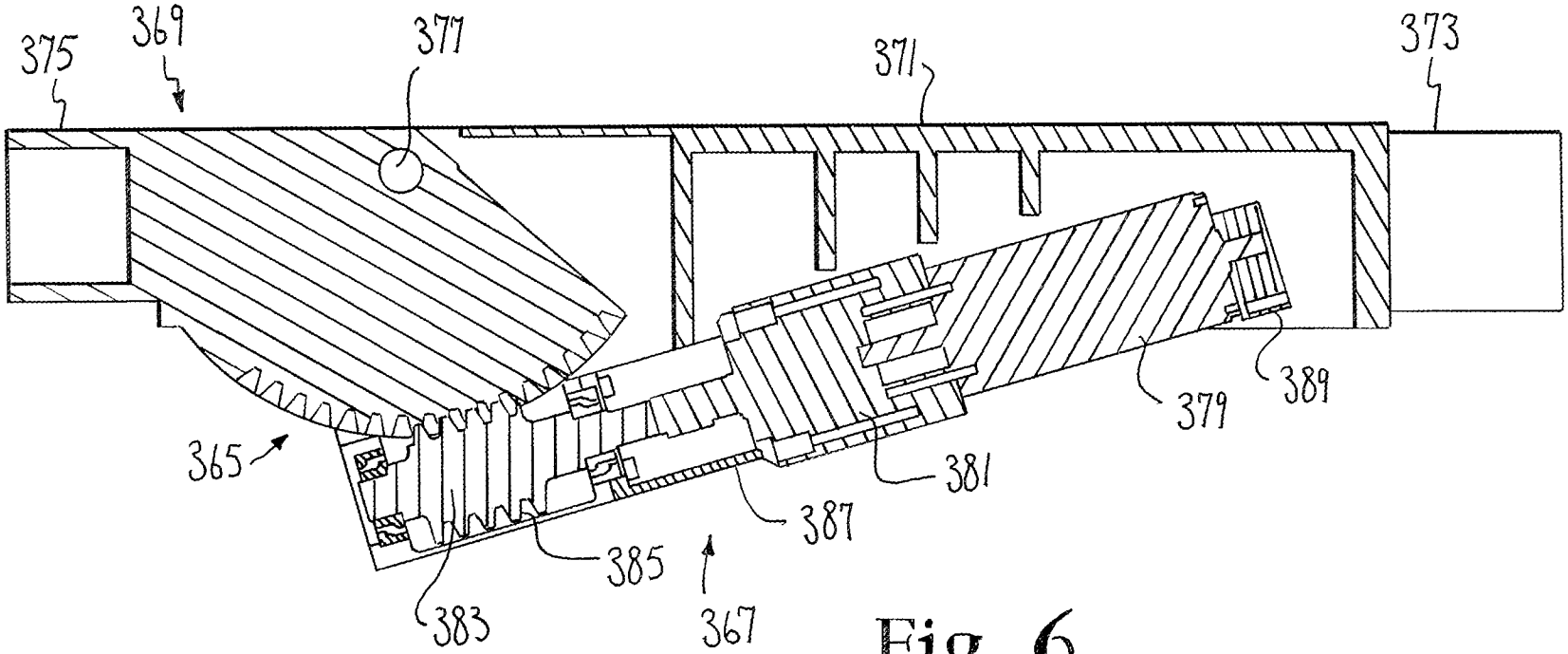
FIG. 6 is a greatly enlarged fragmentary cross sectional view similar to FIG. 5 and illustrates details of a hinge motor and a worm drive mechanism for articulating a hinge of the body support frames.
Figure 8:
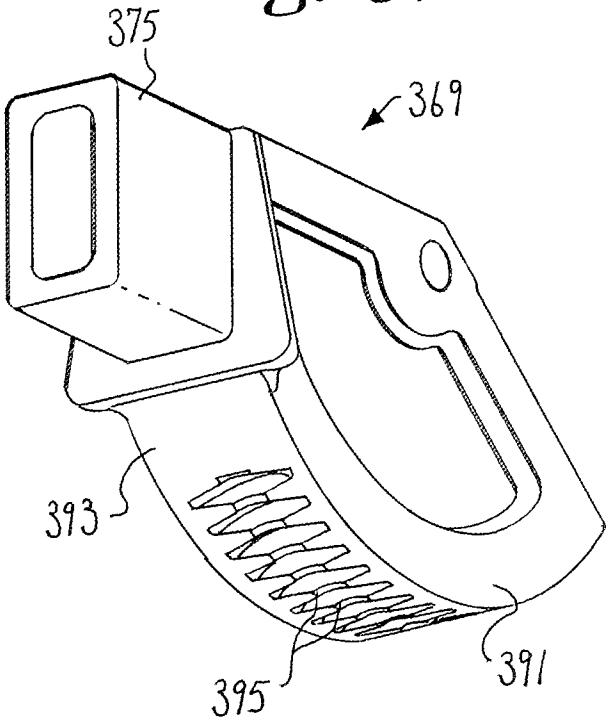
FIGS. 7 and 8 are greatly enlarged fragmentary perspective views of a worm gear of the worm drive mechanism of the body support frames.
Figure 7:
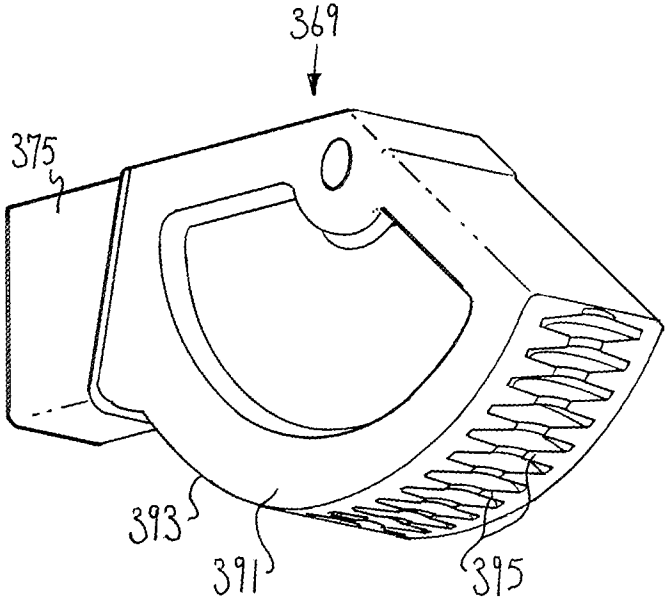

On the illustrated patient support apparatus 301, hinged articulation of the patient support assembly 311 is actuated by a pair of hinge motor assemblies 365 which are engaged between the upper and lower body support frames 303 and 305. Referring to FIGS. 6-8, each of the illustrated hinge or angle motor assemblies 365 includes a worm drive unit 367 mounted on one of the body support frames and a worm gear unit 369 on the opposite body support frame. As illustrated in FIG. 5 and in other figures, the worm drive unit 367 is mounted on the lower body support frame 305, and the worm gear unit 369 is mounted on the upper body support frame 303.

Returning to FIG. 6, each illustrated worm drive unit 367 is mounted in a hinge motor housing 371 having a motor housing stub 373 which is received in and secured within a hinge end of an associated one of the lower body support members 342. The worm gear unit 369 has a worm gear mounting stub 375 which is received in and secured within a hinge end of an associated upper body support member 328. The motor housings 371 are hingedly connected to the worm gear units 369 at the hinge axis 325 by hinge pins 377 to thereby hingedly connect the upper and lower body support frames 303 and 305. In an embodiment of the patient support assembly 301, the hip pads 362 are secured to the motor housings 371 rather than directly on the lower body support members 342.

The illustrated worm drive unit 367 includes a rotary electric hinge motor 379 engaged through hinge motor gearing 381 with a substantially cylindrical "worm" 383 having one or more helical threads 385 or advancement structures formed on an external surface thereof. The gearing 381 includes internal gears (not shown) which reduce the rotary speed of the motor 379 to an appropriate rate for the worm 383. A housing of the motor 379 is joined to a housing of the gearing 381. The drive unit 367 includes a worm bracket 387 having bearing sets in which the worm 383 is rotatably mounted. The illustrated worm drive unit 367 has a hinge encoder 389 engaged therewith which outputs a hinge angle signal having a value which is proportional to the angle of articulation between the upper and lower body support frames 303 and 305 about the hinge axis 325. Rotary and angle encoders which are appropriate for use as the hinge encoder 389 are well known by those skilled in mechanical and electrical control arts.

Referring to FIGS. 7 and 8, the illustrated worm gear unit 369 is formed by worm gear sector 391 having an outer cylindrical surface 393 with gear teeth 395 formed therein. The teeth 395 are helical segments formed into the cylindrical surface 393 and are shaped to mesh with the worm thread 385. The worm gear mounting stubs 375 extend from the worm gear sector 391. When the hinge motor housings 371 are hingedly connected to the worm gear units 369 by the hinge pins 377, the worm threads 385 are positively engaged with the worm gear teeth 395 whereby rotation of the worms 383 by the motors 379 cause hinged articulation of the upper and lower body support frames 303 and 305 about the hinge axis 325.

Although a specific embodiment of the hinge motor assemblies 365 is described and illustrated, other configurations of hinge motor assemblies 365 are contemplated. It is also foreseen that the patient support assembly 311 can be hingedly articulated by motors (not shown) located at the head and/or foot ends thereof. It is foreseen that the body support frames 303 and 305 could be hingedly connected to the head and foot end support assemblies 316 and 318 respectively but not hingedly connected to one another, as disclosed in U. S. Published Application 2011/0107516, which is incorporated herein by reference.

The head and foot end support assemblies 316 and 318 are somewhat similar in structure and function. The end support assemblies 316 and 318 are sometimes referred to as support piers or support columns. The head end support assembly 316 includes a transversely extending head end base 400 having a head end lift column 402 upstanding from a central region thereof and terminating in a head end articulation mechanism 404. Similarly, the foot end support assembly 318 includes a transversely extending foot end base 406 with a foot end lift column 408 upstanding from a central region thereof and terminating an a foot end articulation mechanism 410. The illustrated end support bases 400 and 406 have casters 412 to render the patient support apparatus 301 mobile. Preferably, the casters 412 are capable of swiveling about vertical axes and being releasably locked in position when needed. Similarly, the casters 412 preferably have brake mechanisms (not shown) to selectively brake wheels thereof when needed. As illustrated, the head and foot end bases 400 and 406 are interconnected by the center beam 320.

Figure 2:
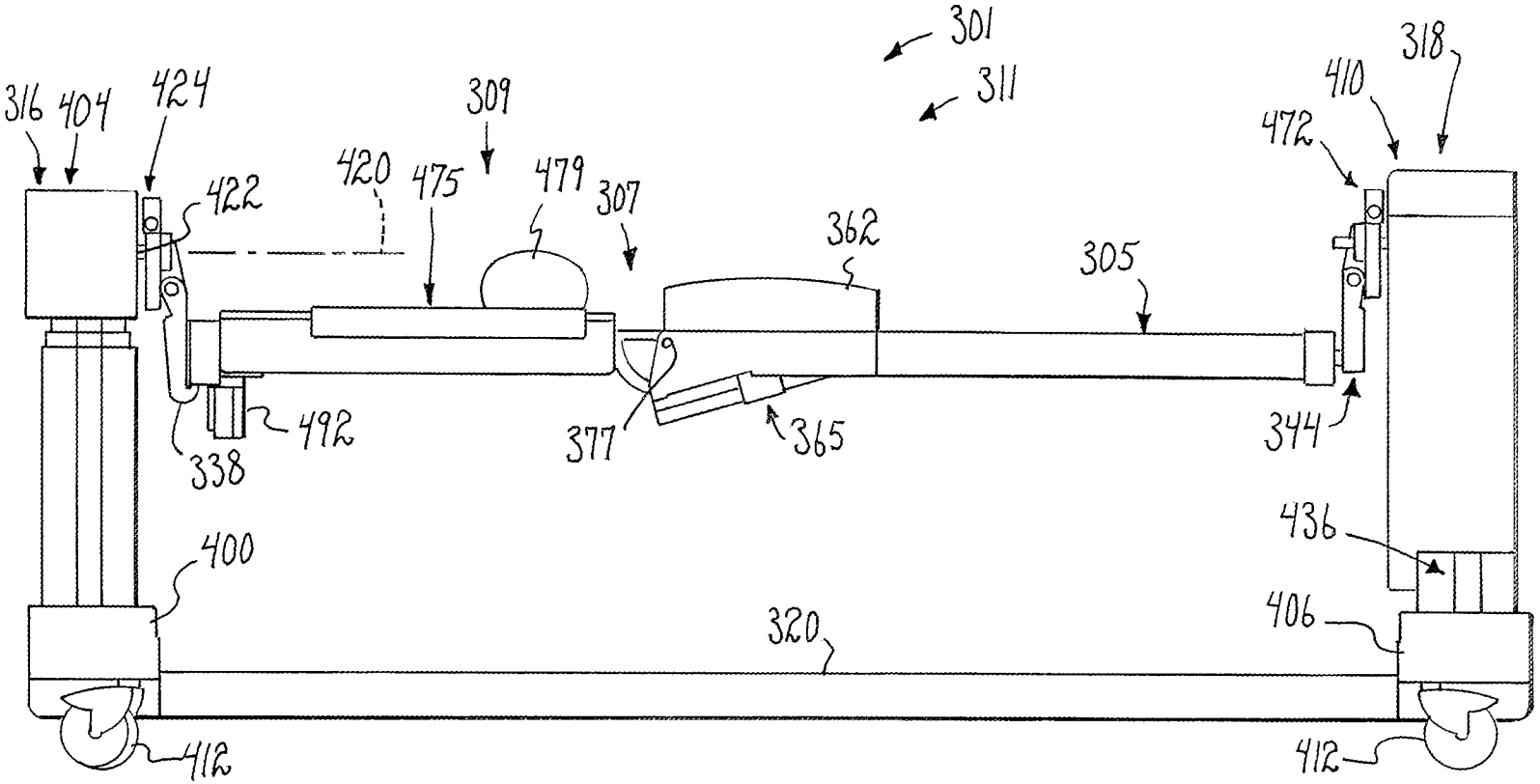
FIG. 2 is a side elevational view of the patient support structure with body support frames thereof in 180° or hinge-neutral alignment.

Referring to FIGS. 2 and 15, the illustrated head end lift column 402 includes three column sections which are telescoped. A head end lift mechanism (not shown) within the column 402 is activated to extend or retract the column sections. The lift mechanism may be a pneumatic or hydraulic cylinder or cylinders or some other type of lift mechanism, such as one or two jack screws (not shown) rotated by associated electric motors (not shown). Telescoping lift column arrangements are well known in patient support systems to those skilled in these arts.

The head end lift column 402 terminates at an upper end in the head end articulation mechanism 404. The illustrated articulation mechanism 404 includes a mounting plate 416 which has a roll motor 418 (FIG. 15) mounted thereon. The roll motor 418 is activated to rotate the patient support assembly 311 about a substantially horizontal head end roll axis 420 which passes through a roll motor shaft 422 (FIG. 2). The illustrated roll motor 418 preferably incorporates a harmonic drive mechanism. Harmonic drives are well known in mechanical arts and have the benefits of low backlash or play, light weight and compactness, and very high gear ratios. Alternatively, other types of roll motors and drive mechanisms can be employed in the patient support apparatus 1.

The illustrated head end articulation mechanism 404 includes a head end ladder bracket assembly 424 secured to the roll motor shaft 422. The assembly 424 includes a ladder bracket base plate 426 which is secured to the shaft 422 and a hinge or coupler plate 428 which is releasably connected to the base plate 426 by quick release pins or connectors 430. The hinge plate 428 has a pair of transversely spaced hinge lugs 432 depending therefrom. The lugs 432 have the hinge brackets 338 of the head crossbar assembly 330 pivotally connected thereto. Pivotal engagement of the hinge brackets 338 with the hinge lugs 432 enables the upper body support frame 303 to pivot relative to the head end support assembly 316.

Figure 14:
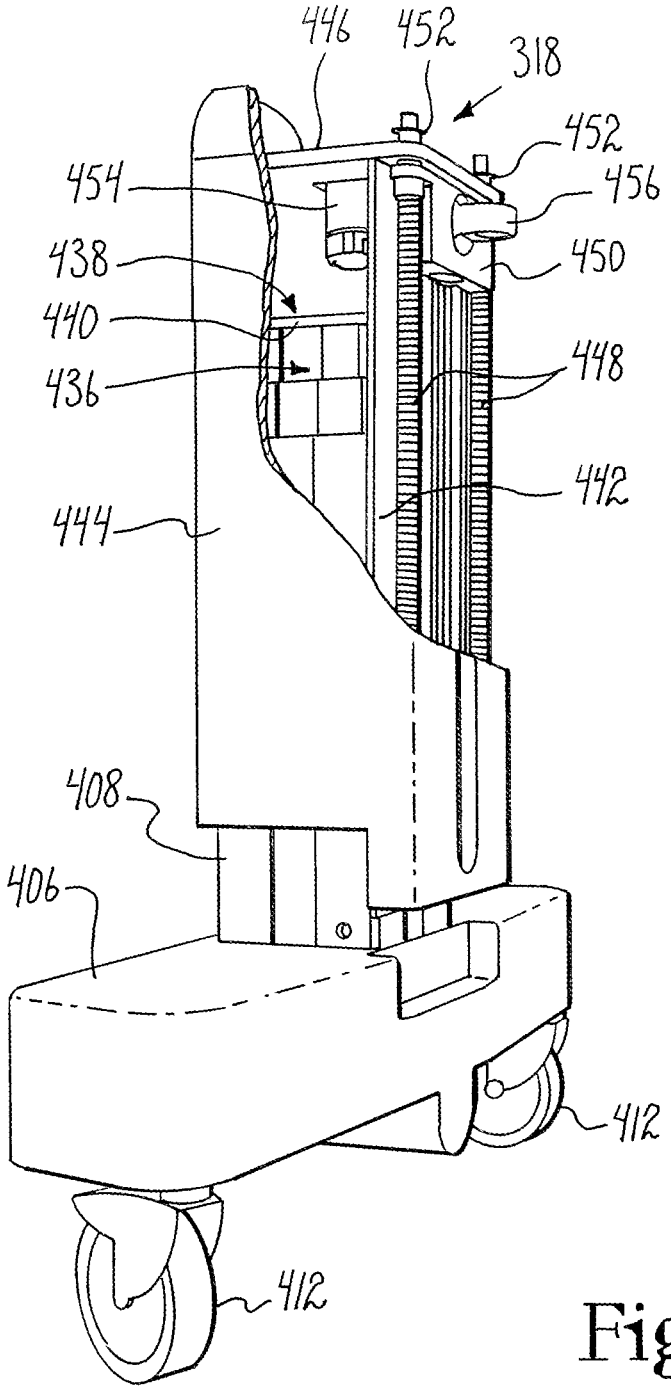
FIG. 14 is an enlarged fragmentary perspective view of a foot end support of the patient support structure with portions broken away to illustrate details of a secondary lift mechanism thereof.

Referring particularly to FIGS. 2, 13, and 14, the foot end support assembly 318 includes the foot end base 406 which has a foot end lift column 408 upstanding from a middle region thereof. The foot end base 406 has the casters 412 which are similar in function to the casters 412 on the head end base 400. The foot end lift column 408 forms a primary lift mechanism 436 for the foot end of the patient support assembly 311. The illustrated lift column 408 is a telescoping mechanism and is substantially similar to the front end lift column 402.

In the illustrated patient support apparatus 1, the foot end of the patient support assembly 311 is provided with a greater degree of vertical movement than the head end. An upper section of the lift column 408 supports a secondary lift framework 438 forming a support for a secondary lift mechanism 439 of the foot end support assembly 318. The framework 438 includes a horizontal mounting plate 440 secured to a top end of the lift column 408, an elongated vertical back plate 442 secured to the mounting plate 440, vertical side plates 444 secured to the mounting plate 440 and the back plate 442, and a horizontal top plate 446 secured to the back plate 442 and the side plates 444. The components 440-446 may be secured to one another by welding or by other means.

A pair of vertically extending, transversely spaced, and parallel secondary lift screws 448 are mounted in bearings in the top plate 446 and a bottom plate (not shown) extending from a lower end of the back plate 442. The lift screws 448 are threadedly engaged with outer ends of a secondary lift carriage 450 whereby simultaneous rotation of the lift screws 448 lifts or lowers the carriage 450. In the illustrated secondary lift mechanism 439, upper ends of the lift screws 448 have driven sprockets 452 mounted thereon. A reversible secondary lift motor 454 is mounted on the top plate 446 and has a drive sprocket (not shown) mounted on a motor shaft (not shown) of the motor 454. A sprocket chain (not shown) is engaged with the drive sprocket and the driven sprockets 452 whereby activation of the motor 454 causes rotation of the lift screws 448. The lift carriage 450 has a ladder pivot 456 rotatably mounted therein. The lift screws 448, lift carriage 450, and the sprockets 452 are covered by a secondary lift housing 458 and a top cover 460. The housing 458 is provided with a central slot 462 to provide clearance for the ladder pivot 456.

The ladder pivot 456 has a foot ladder plate 464 secured thereto which has a foot end coupler or hinge plate 466 releasably connected thereto by quick-release connectors 468. The hinge plate 466 has a pair of transversely spaced hinge lugs 470 depending therefrom. The plates 464 and 466, the connectors 468, and the hinge lugs 470 form a foot end ladder bracket assembly 472. The hinge lugs 470 is hingedly connected to the hinge lugs 358 of the foot crossbar assembly 344 to enable hinged movement of lower body support frame 305 relative to the foot end support assembly 318. Connection of the ladder plate 464 to the ladder pivot 456 provides a passive pivot at the foot end of the patient support assembly 311 when the assembly is subjected to roll movement by activation of the roll motor 418 within the head end support assembly 316. It should be noted that the patient support assembly 311 can only be rolled when the ladder pivot 456 is aligned with the roll motor shaft 422. Otherwise, the foot end of the lower body frame 311 would be swung in an arc radially spaced from the ladder pivot 456.

When a patient is supported on the patient support assembly 311 and the upper and lower body support frames 303 and 305 are pivoted about the hinge axis 325, a bending axis of the patient's body is spaced radially from the hinge axis 325. Because of this, the patient's body tends to be stretched when the patient support assembly 311 is hinged upwardly and compressed when the assembly 311 is hinged downwardly. In order to relieve such stretching or compressing stress on the patient's body, the patient must be repositioned or the upper or lower portion, or both portions, of the patient's body must be able to move linearly along the appropriate body support frame 303 or 305. The body slide assembly 309 is provided on either the upper or lower body support frame 303 or 305. It is also foreseen that a body slide assembly 309 could be provided on both of the body support frames 303 and 305.

Figure 9:
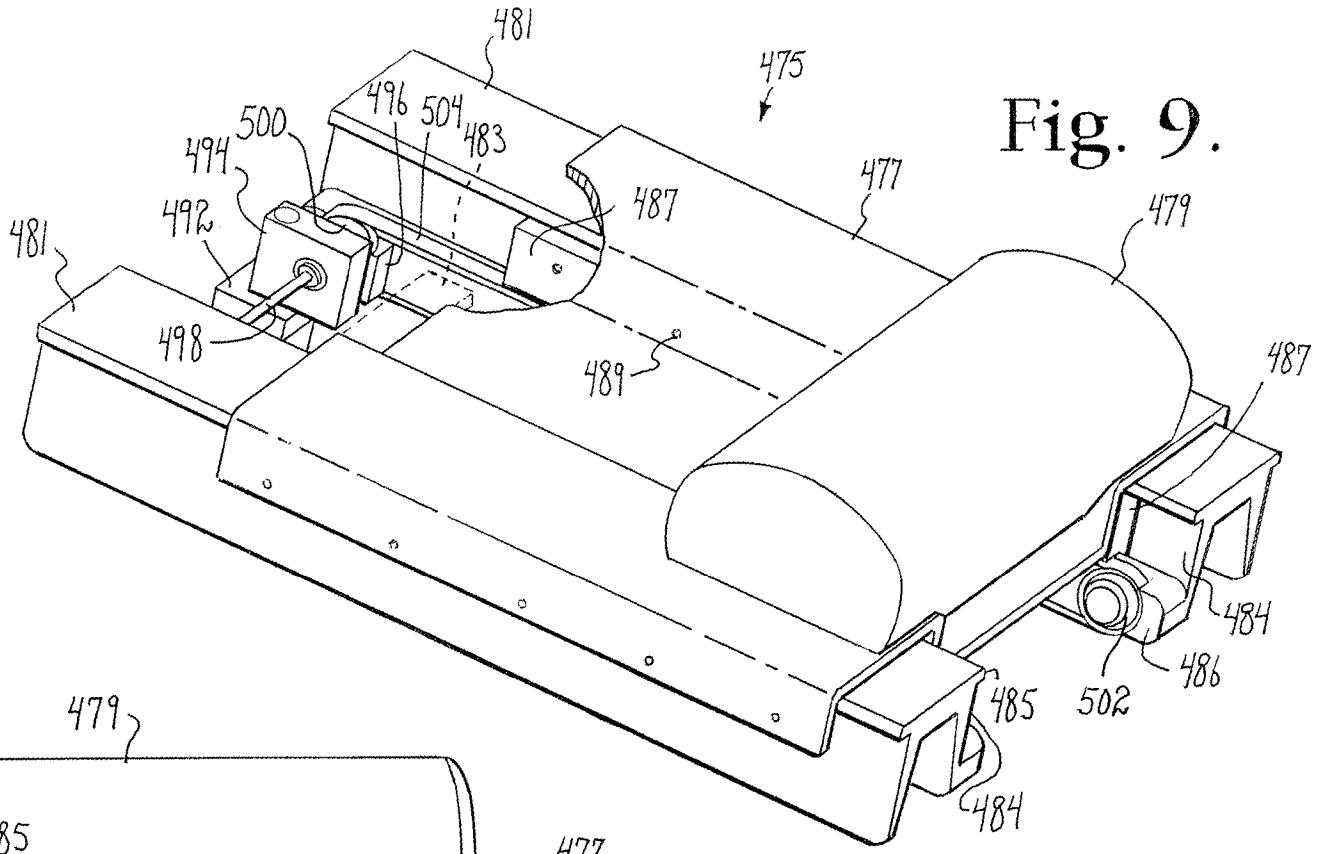
FIG. 9 is an enlarged perspective view of an upper body slide mechanism of the patent support structure, shown removed from the patient support apparatus and with a portion broken away to show details thereof.
Figure 10:
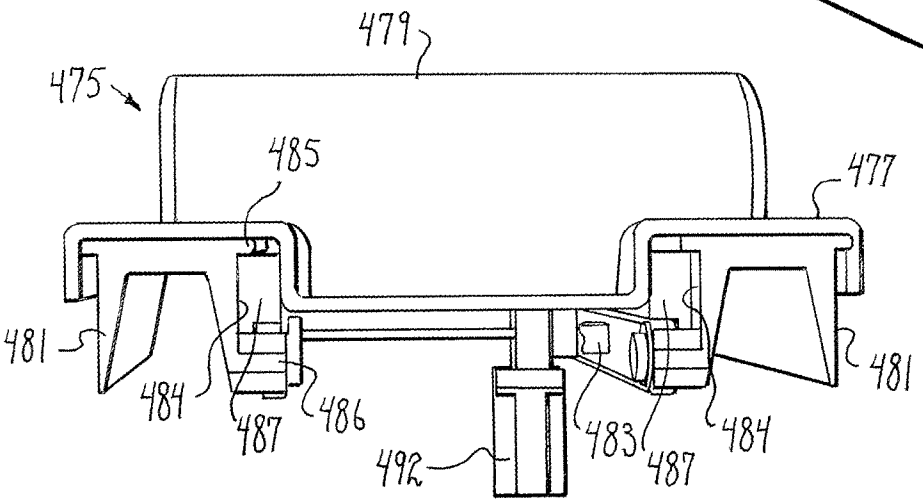
FIG. 10 is an end perspective view of the upper body slide mechanism.

Referring to FIGS. 9 and 10, the illustrated body slide assembly 309 is implemented as an upper body slide mechanism 475 of the patient support apparatus 301, including an upper body trolley structure 477 having a sternum pad 479 secured thereto. The illustrated mechanism 475 includes a pair of elongated upper body slide guide members 481 which are sized and shaped to be removably received on the upper body support members 328 of the upper body support frame 303. The configuration of the guide members 481 enable the entire upper body slide mechanism 475 to be removed from the upper body support frame 303 when necessary. The guide members 481 are interconnected by cross members 483 which extend therebetween to form a rigid framework. Cross sections of the left and right hand guide members 481 are mirror images, and the guide members 481 have guide grooves 484, formed on the illustrated guide members 481 by an upper flange 485 and a lower ledge 486 on inner sides of each guide member 481. The grooves 484 slidably receive elongated trolley guide bars 487 which are secured to the trolley 477, as by fasteners 489.

It is foreseen that the upper body slide mechanism 475 could be adapted for passive sliding to relieve stretching or compressing stresses on the patient's body when the patient support assembly 311 hinges up or down. However, a surgeon would likely prefer for the patient to be supported a stable and stationary platform during surgical procedures. Therefore, such a passively sliding upper body slide mechanism would require a brake (not shown) to fix the position thereof.

In an embodiment of the patient support apparatus 301, the upper body slide mechanism 475 is provided with a upper body slide motor 492 engaged with the upper body trolley 477 to positively translate it along the upper body slide guides 481. The illustrated slide motor 492 is engaged with a gearbox 494 which is connected by motor mount brackets 496 to one of the upper body slide guides 481. A transversely extending slide motor shaft 498 extends through the gearbox 494 and has drive sprockets or pulleys 500 secured on the opposite ends thereof. The sprockets 500 are rotatably mounted on the inner sides of the slide guides 481. Freewheeling or driven sprockets or pulleys 502 are rotatably mounted on the inner sides of the slide guides 481 at opposite ends thereof. An upper slide timing belt 504 is reeved about the pairs of drive and driven sprockets 500 and 502 and secured to the trolley guide bars 487. The timing belts 504 are preferably toothed on their inner surface, as are the sprockets 500 and 502, to prevent slippage between the belt 504 and the sprockets 500 and 502.

Figure 11:
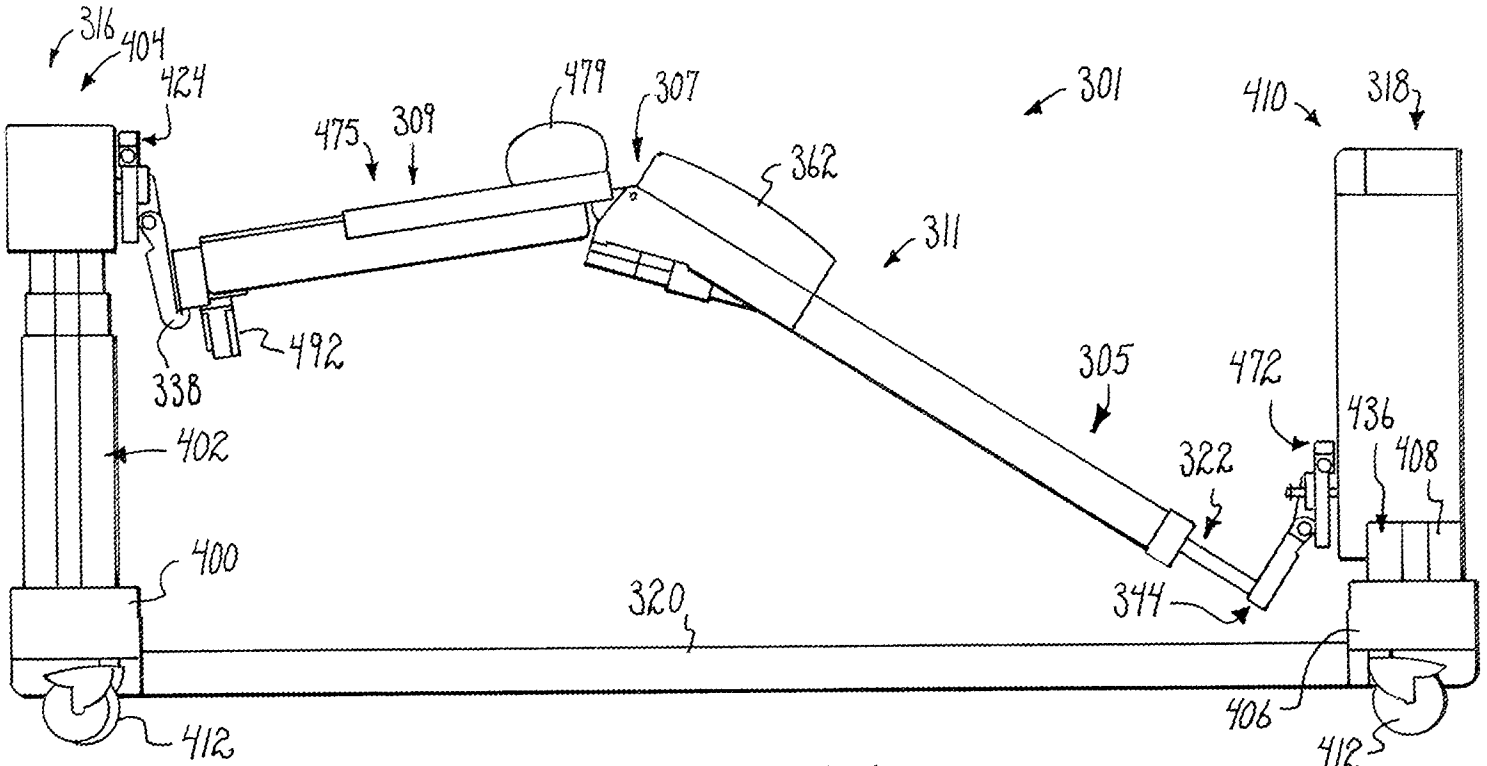
FIG. 11 is a side elevational view of the patient support structure with the body support frames in a hinge-up relationship, with the upper body slide moved toward the hinge and with a foot end of a lower body support frame in a lowered position.
Figure 12:
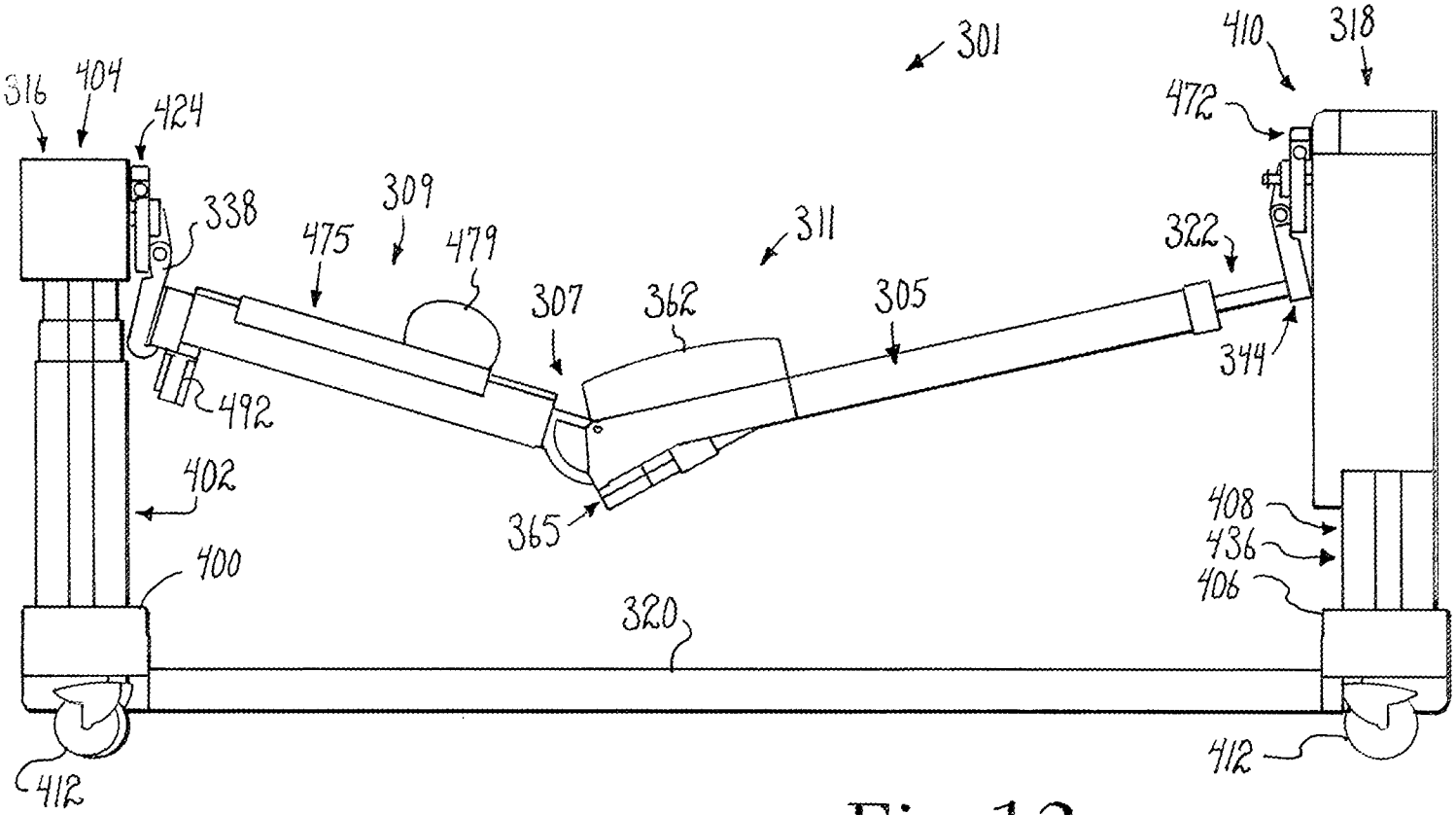
FIG. 12 is a side elevational view of the patient support structure with the body support frames in a hinge-down relationship, with the upper body slide moved away from the hinge.

The upper body slide mechanism 475 includes an upper body slide (UBS) encoder 506 (FIG. 23) to accurately measure movement of the trolley 477 relative to the guides 481 and, thus, to the upper body support frame 303 and to provide a digital slide signal indicating the position of the trolley 477 relative to the body support frame 303. The encoder 506 may be incorporated into the motor 492, the gearbox 494, the belt 504, the guide bars 487, or the like, as would occur to one skilled in appropriate arts. The encoder 506 enables control of movement of the trolley 477, and thus the upper body of the patient, with hinging movement of the body support frames 303 and 305, as will be described below, so that the trolley 477 moves toward the hinge axis 325 (as shown in FIG. 11) when the patient support assembly 311 is hinged upwardly and away from the hinge axis 325 (as shown in FIG. 12) when the assembly 311 is hinged downwardly.

Figure 18:
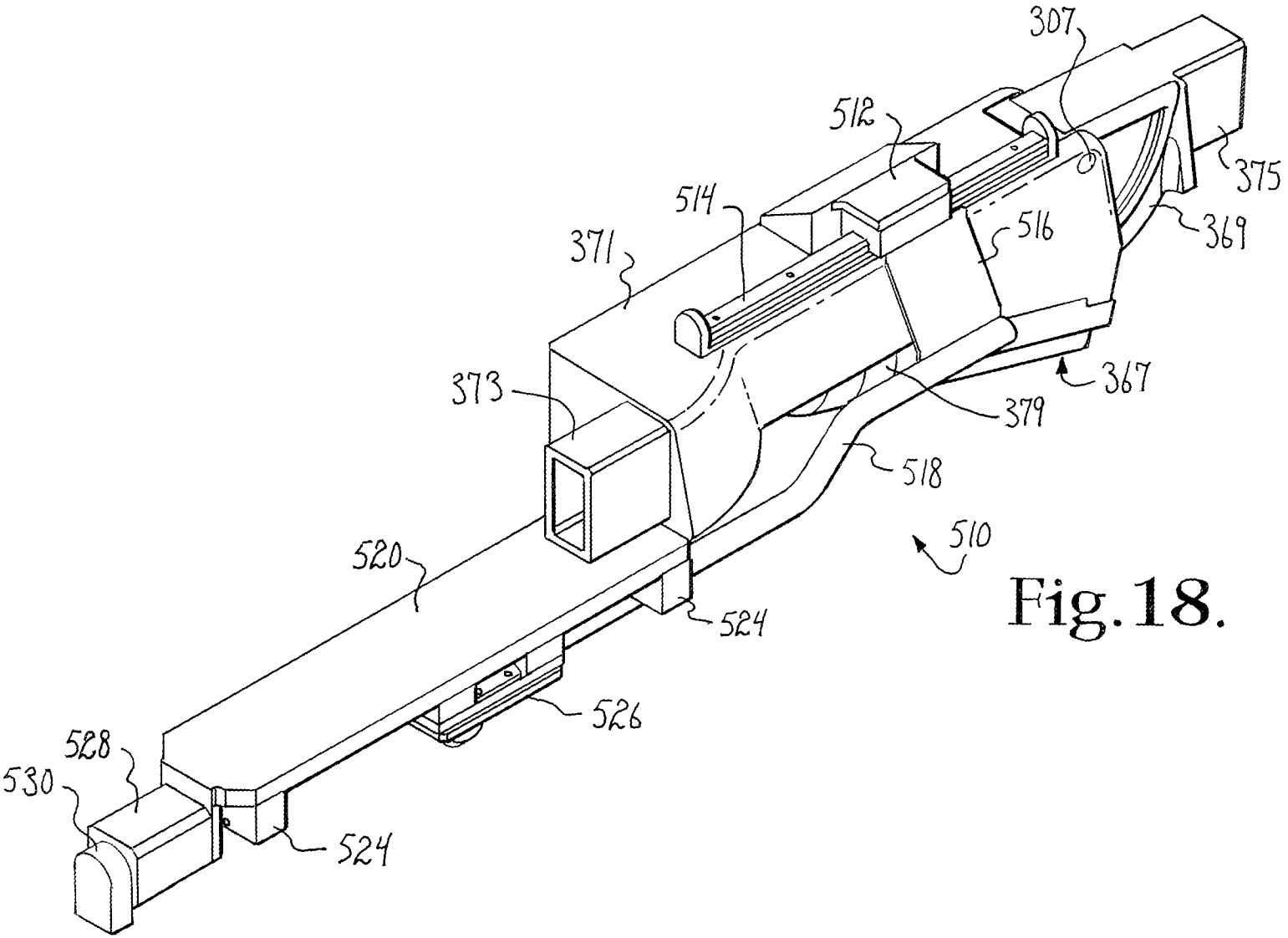
FIG. 18 is a greatly enlarged fragmentary perspective view of components of the body support frames and illustrate details of the lower body slide mechanism.
Figure 19:
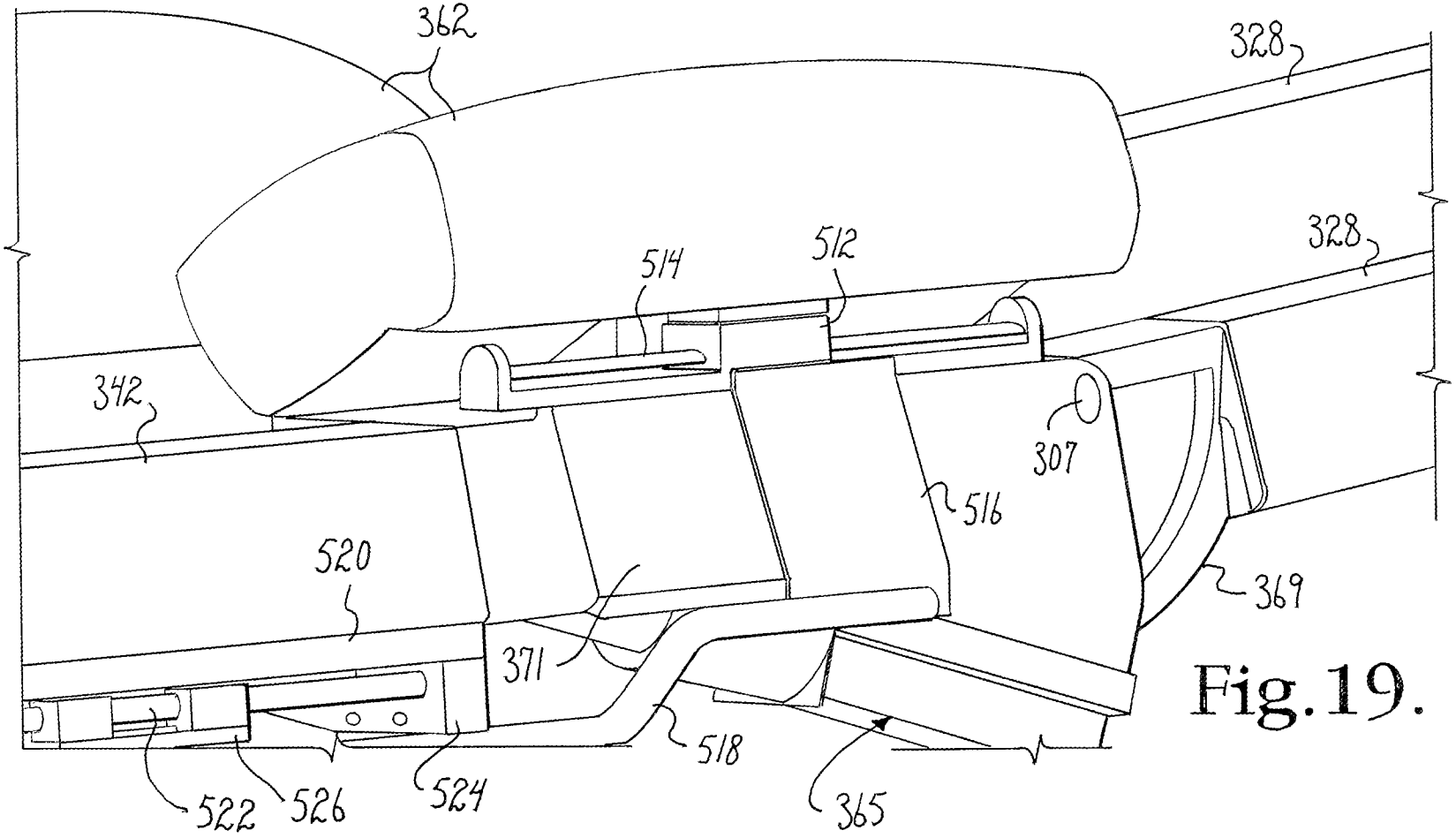
FIG. 19 is a greatly enlarged fragmentary perspective view of the modified patient support structure with the body support frames in a slightly hinge-down relationship.

In some circumstances it might be considered desirable to provide sliding adjustment of the lower body of a patient in response to upward or downward hinging articulation of the patient support assembly 311. Referring particularly to FIG. 18, an embodiment of the body slide assembly 309 is implemented as a lower body slide mechanism 510. In an embodiment of the lower body slide mechanism 510, such a mechanism is provided on each of the hinge motor housings 371, with the mechanisms on the right and left hinge motor housings 371 being substantially mirror images of one another.

Each illustrated lower body slide mechanism 510 includes a hip pad support platform 512 in sliding engagement with a linear guide member 514 secured to a top surface of the associated hinge motor housing 371. The platform 512 is connected by a hip pad bracket 516 to a hip pad actuator rod 518. An elongated hip pad actuator support base or plate 520 is secured to the lower side the lower body support member 342 associated with the particular hinge motor housing 371 and may also be secured to the housing 371. A hip pad actuator screw 522 is rotatably supported in spaced apart screw bearings 524 depending from the support base 520. A hip pad actuator nut 526 is meshed with the screw 522 so that rotation of the screw 522 causes linear reciprocation of the nut 526 along the support base 520. A lower body slide actuator motor 528 is mounted on the support base and is engaged with the actuator screw 522 to rotate it.

Figure 20:
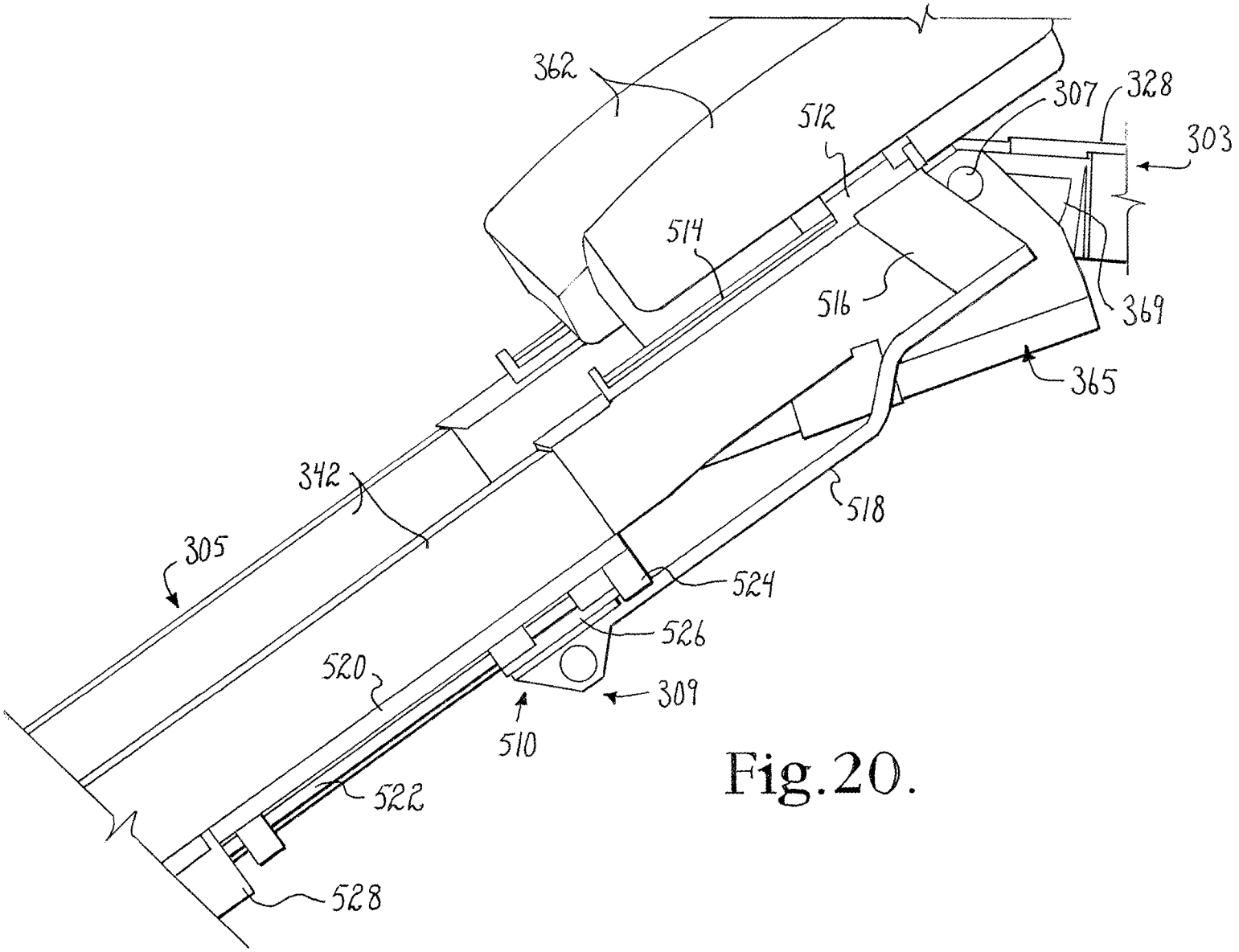
FIG. 20 is a perspective view of the modified patient support structure with the body support frames in a hinge-up relationship and with the lower body slide mechanism moved toward the hinge.
Figure 21:
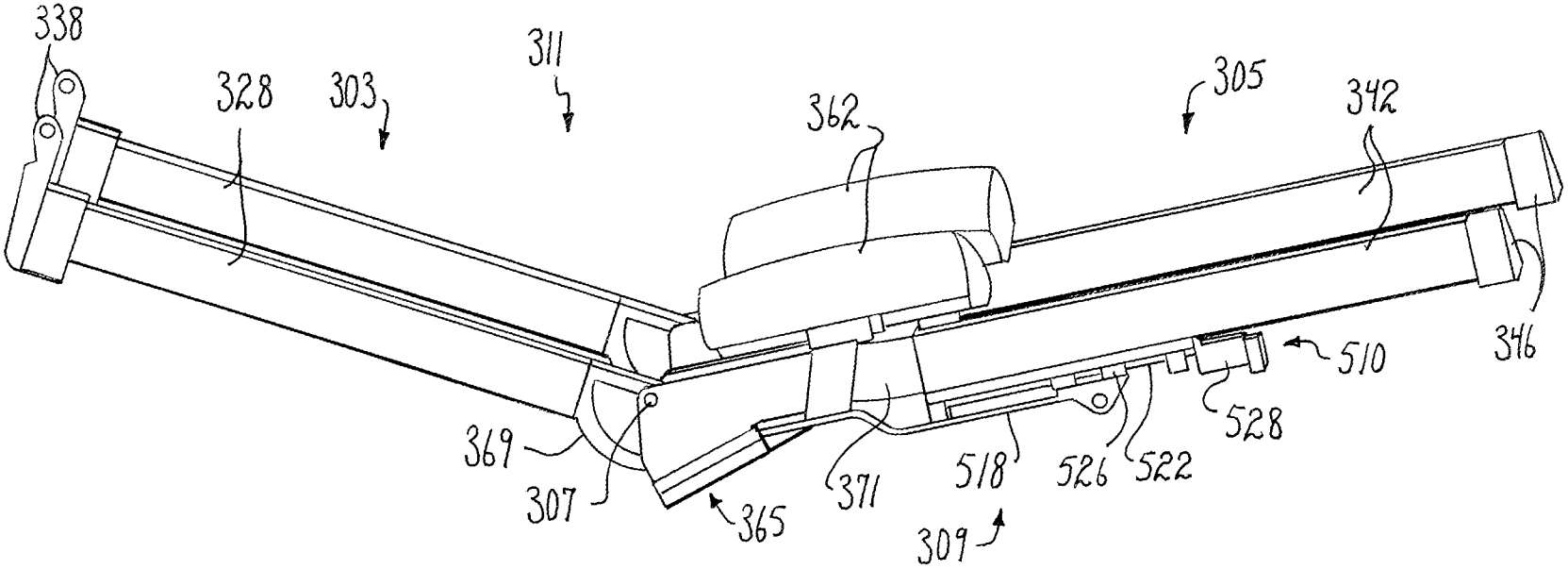
FIG. 21 is a fragmentary perspective view of the modified patient support structure with the body support frames shown in a hinge-down relationship and with the lower body slide mechanism moved away from the hinge.
Figure 22:
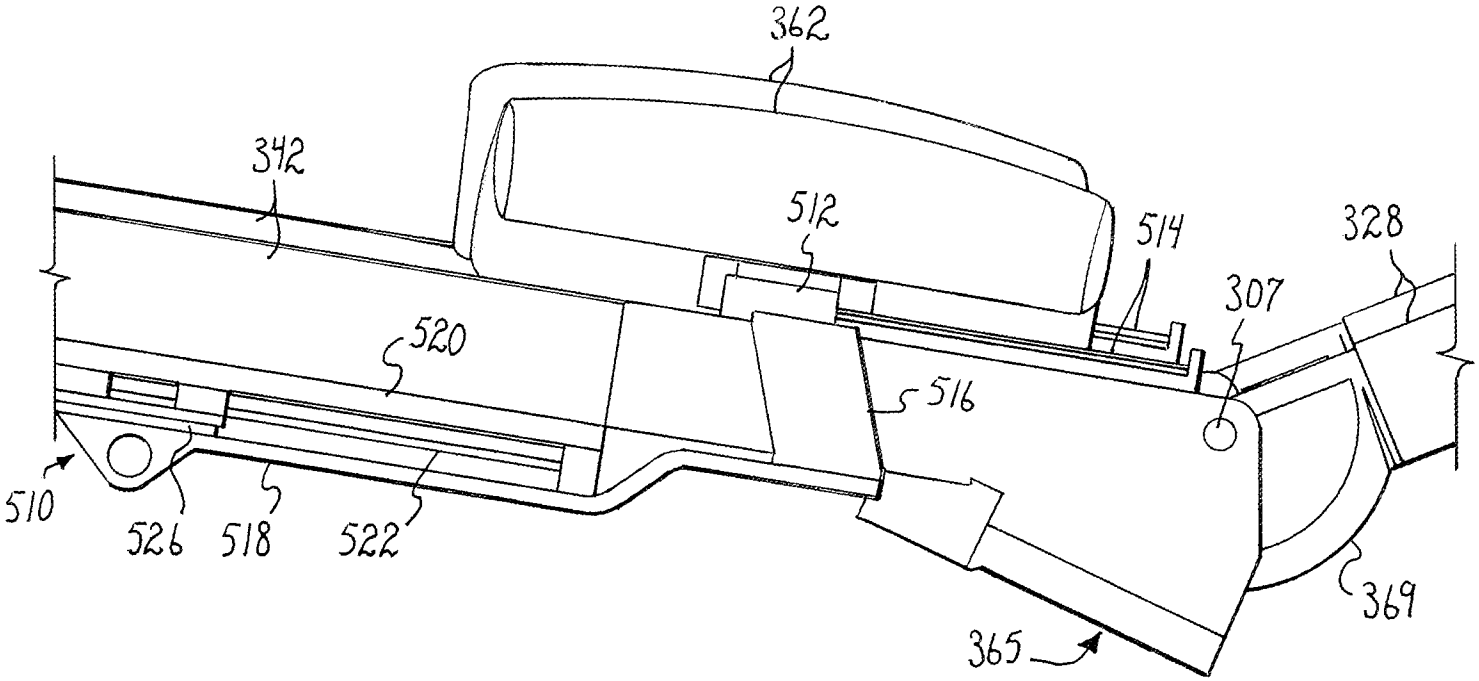
FIG. 22 is an enlarged fragmentary perspective view similar to FIG. 21 and shows the body support frames in a hinge-down relationship.

The motor 528 has a lower body slide encoder 530 engaged therewith and provides a digital lower body slide signal which indicates the linear position of the hip pad 512 relative to the lower body support frame 305. The lower body slide encoder 530 enables coordination of the movement of the lower body slide mechanism 510 so that the hip pad 512 is moved toward the hinge axis 325 (as shown in FIG. 20) when the patient support assembly 311 is hinged upwardly and away from the hinge axis 325 (as shown in FIG. 21) when the patient support assembly 311 is hinged downwardly. The hip pad actuator rod 518 is connected to the hip pad actuator nut 526 so that linear movement of the nut 526 along the screw 522 causes the hip pad platform 512 to move linearly along the guide 514. The hip pad platform 512 has one of the hip pads 362 secured thereto.

Figure 23:
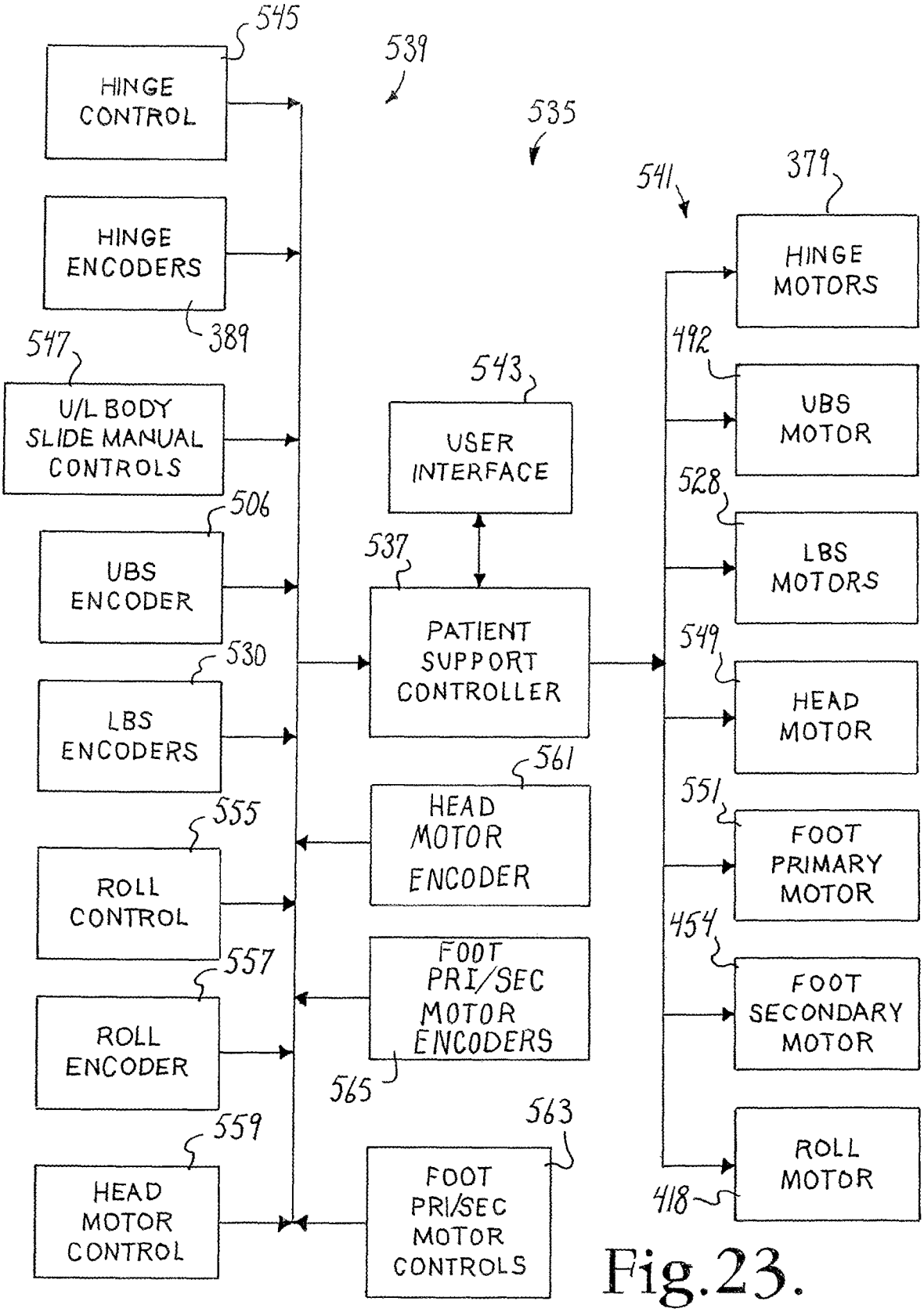
FIG. 23 is a block diagram showing control components of the patient support structure for digitally coordinating the positioning of body slide mechanisms with the angle of the hinge connecting the body support frames.

Referring to FIG. 23, the patient support apparatus 301 includes a patient support control system 535 to enable medical personnel to control the configuration and orientation of components of the apparatus 301. The control system 535 includes a patient support controller or computer 537 having a plurality of patient support input controls 539 and a plurality of patient support actuators 541 interfaced thereto. The controller 537 includes a user interface 543, which may include a keyboard and display (not shown), to enable medical personnel to enter data into the controller 537 and to display alphanumeric and/or graphic information regarding states and of components of the apparatus 301.

The inputs 539 include a hinge control 545 to enable personnel to cause the patient support assembly 311 to hinge upwardly or downwardly by directional activation of the hinge motors 379. As hinging articulation of the patient support assembly 311 occurs, the hinge encoders 389 provide hinge angle signals to the controller 537 to track the angle of the upper and lower body support frames 303 and 305 about the hinge axis 325 (FIG. 4). In response to the hinge angle tracking, the controller 537 activates the upper body slide motor 492 and/or the lower body slide motors 528 to move the respective upper body slide mechanism 475 and/or the lower body slide mechanism 510 in such a direction from the hinge axis 325 and to such a linear extent to provide translation compensation to prevent stretching or compressing a portion of the body of a patient supported on the patient support assembly 311 as the patient support assembly is hingedly articulated.

The control system 535 preferably includes a manual body slide control 547 to enable initial positioning of the body slide assembly 309. The control 547 may be provided for controlling the upper body slide motor 492, the lower body slide motors 528, or both should both an upper body slide 475 and a lower body slide mechanism 510 be provided on the patient support apparatus 301. When the body slide assembly 309 is initially positioned, that position is detected by the upper body slide encoder 506 or lower body slide encoder 530 and conveyed to the controller 537 as the reference position of the body slide assembly 309. Thereafter, the upper body slide motor 492 is, or lower body slide motors 528 are, activated in such a manner as to coordinate the position of the associated body slide assembly 309 with the hinge angle as detected by the hinge encoders 389.

Generally upper body slide trolley 477 or hip pad support platform 512 is moved toward the hinge axis 325 when the patient support assembly 311 is hinged upwardly and away from the hinge axis when the patient support assembly is hinged downwardly. The amount of linear movement of the trolley 477 or platform 512 is proportioned to the hinge angle between the body support frames 303 and 305 to avoid stretching or compression stresses in the patient's body as the patient support assembly 311 is hingedly articulated. The linear to angular movement relationship can vary depending on dimensional factors of the patient, such as the height, weight, girth, proportion of the upper body length to lower body length of the patient, and other factors. Such factors can be entered into the patient support controller 537 to control the proportion of linear movement of the trolley 477 or platform 512 to the hinge angle of the body support frames 303 and 305 in relation to the dimensional factors of the patient.

In addition to the hinge motors 379 and the body slide motors 492 and 528, the patient support apparatus 301 includes the roll motor 418 (FIGS. 15 and 23), a head end lift motor or head motor 549 (FIG. 23), a foot end primary lift motor 551, and the foot end secondary lift motor 553 (FIGS. 14 and 23). Each of the motors 549, 551, 454, and 418 includes a corresponding control for its operation.

A roll control 555 is interfaced to the controller 537 for reversibly activating the roll motor 418. A roll encoder 557 is engaged with the roll motor 418 and interfaced with the controller 537 to track the roll angle of the patient support assembly 311. A head motor control 559 is interfaced to the controller 537 for activating the head lift motor 549 to raise or lower the head end of the patient support assembly 311. A head motor encoder 561 is engaged with the head motor 549 and interfaced with the controller 537 to track the vertical position of the head end of the patient support assembly 311. Foot primary and secondary (PRI/SEC) controls 563 are interfaced to the controller 537 for activation respectively the foot primary motor 551 and the foot secondary motor 454 to lift and lower the foot end of the patient support assembly 311. Foot primary and secondary motor encoders 565 are engaged with the foot primary and secondary motors 551 and 454 and interfaced with the controller 537 to track the vertical position of the foot end of the patient support assembly 311.

Embodiments of the patient support apparatus 301 have been described and illustrated in which the body slide position is digitally coordinated with the hinge angle of the body support frames 303 and 305. Such embodiments disclose a hinge connection between the body support frames 303 and 305. However, it is foreseen that the present invention could also be advantageously applied to types of patient support apparatus to enable digital coordination of the linear position of a body slide assembly 309 provided on one of a set of body support frames (not shown) which are not hingedly connected but which are capable of being positioned in a range of angular relations. The present invention is also intended to encompass such types of patient support apparatus.

It is to be understood that while certain forms of the present invention have been illustrated and described herein, it is not to be limited to the specific forms or arrangement of parts described and shown.

What is claimed and desired to be secured by Letters Patent is as follows:

1. A patient positioning apparatus for supporting a patient above a floor, the patient having a lower back region, the patient positioning apparatus comprising:

a base with a head end portion and a foot end portion; and an elongate patient support structure supported above the floor by the base and configured for positioning the patient prone thereon, the patient support structure including an upper body slide mechanism, the upper body slide mechanism comprising a trolley and an upper body slide motor engaged with the trolley to positively translate the trolley along a frame of the patient support structure, wherein the upper body slide mechanism extends the lower back region when the mechanism is moved into an inclined orientation with the mechanism translating toward the head end portion of the base relative to the patient support structure.

2. The patient positioning apparatus of claim 1, wherein the frame comprises an upper body support frame and a lower body support frame, the upper body support frame supporting the upper body slide mechanism, the upper body support frame connected to the lower body support frame via a pair of spaced apart hinges, wherein the upper body support frame and the lower body support frame are configured to articulate about the pair of spaced apart hinges.

3. The patient positioning apparatus of claim 1, further comprising a pair of spaced apart pelvic pads positioned on the lower body support frame.

4. The patient positioning apparatus of claim 1, wherein the frame includes a spaced apart first and second rails, the trolley comprising spaced apart first and second channels, the first rail being disposed in the first channel, the second rail being disposed in the second channel.

5. The patient positioning apparatus of claim 1, wherein the first rail includes a first side surface and the second rail includes a second side surface that faces the first side surface, the first rail including a first groove extending into the first side surface and the second rail including a second groove extending into the second side surface, the trolley comprising a first guide bar positioned in the first groove and the a second guide bar positioned in the second groove.

6. The patient positioning apparatus of claim 4, further comprising a gearbox connected to the first rail by motor mount brackets, the motor being engaged with the gearbox.

7. The patient positioning apparatus of claim 6, further comprising a motor shaft extending through the gearbox, the motor shaft comprising sprockets secured on the opposite ends thereof.

8. The patient positioning apparatus of claim 7, wherein the sprockets are rotatably mounted on inner sides of the rails.

9. The patient positioning apparatus of claim 7, wherein the sprockets are rotatably mounted on inner sides of the rails, wherein pulleys are rotatably mounted on the inner sides of the rails at opposite ends thereof, an upper slide timing belt being revved about the sprockets and the pulleys.

10. The patient positioning apparatus of claim 1, wherein the frame includes a spaced apart first and second rails, the trolley comprising spaced apart first and second channels, the first rail being disposed in the first channel, the second rail being disposed in the second channel, the upper body slide mechanism including an encoder configured to accurately measure movement of the trolley relative to the rails and to provide a digital slide signal indicating a position of the trolley relative to the frame.

11. A patient support apparatus for manipulating a patient in a prone position, the patient having a lower back that can be angulated into an extended alignment, the apparatus comprising:

a base with a head end supporting structure and a foot end supporting structure, the base supported on a floor; and an elongate patient support assembly supported above the floor by the base, the patient support assembly having a head end chest pad and a foot end pelvic pad for supporting the patient thereon, the patient support assembly including a lower body slide mechanism connected to the foot end pelvic pad, the lower body slide mechanism comprising an actuator and a motor configured to rotate the actuator, the motor comprising an encoder that provides a digital signal which indicates a linear position of the foot end pelvic pad relative to a frame of the patient support assembly, wherein when the lower back of the patient is angulated into the extended alignment, the lower body slide mechanism and the foot end pelvic pad are moved into an inclined orientation with respect to the floor and the pelvic pad both translates away from and angulates with respect to the head end chest pad.

12. The patient positioning apparatus of claim 11, wherein the motor is mounted directly to the frame.

13. The patient positioning apparatus of claim 11, wherein the frame comprises spaced apart first and second rails each including opposite top and bottom surfaces, the motor being coupled to the bottom surface of one of the rails, the lower body slide mechanism comprising a linear guide movable positioned in a housing, the housing being coupled to the top surface of one of the rails.

14. The patient positioning apparatus of claim 11, wherein the frame includes a hinge between the head end chest pad and the foot end pelvic pad, the hinge defining a hinge axis, the encoder being configured to enable coordination of the movement of the lower body slide mechanism so that the foot end pelvic pad is moved toward the hinge axis when the patient support assembly is hinged upwardly and away from the hinge axis when the patient support assembly is hinged downwardly.

15. A patient support apparatus for manipulating a patient in a prone position, the patient having a lower back that can be angulated into an extended alignment, the apparatus comprising:

a base with a head end supporting structure and a foot end supporting structure, the base supported on a floor; and an elongate patient support assembly supported above the floor by the base, the patient support assembly having a head end chest pad and a foot end pelvic pad for supporting the patient thereon, the patient support assembly including an upper body slide mechanism connected to the head end chest pad, the upper body slide mechanism comprising a trolley and an upper body slide motor engaged with the trolley to positively translate the trolley along a frame of the patient support structure, the head end chest pad being coupled to the trolley, wherein when the lower back of the patient is angulated into the extended alignment, the upper body slide mechanism and the head end chest pad are moved into an inclined orientation with respect to the floor and the head end chest pad translates away from and angulates with respect to the pelvic pad.

16. A patient support apparatus for manipulating a patient, the apparatus comprising:

a foot end support assembly comprising a foot end base and a foot end lift column upstanding from the foot end base;

a head end support assembly comprising a head end base and a head end lift column upstanding from the head end base, the head end lift column spaced apart from the foot end lift column;

a beam connecting the head end base and the foot end base;

an upper body support structure operably coupled to the head end lift column at an outward end thereof, the upper body support structure configured to support a chest pad;

a lower body support structure operably coupled to the foot end lift column at an outward end thereof; and a lower body slide mechanism operably engaged with the lower body support structure and comprising:

a hip pad mounted on a hip pad support subassembly which is configured to slide relative to the lower body support structure;

a lower body slide actuator operably coupled with the hip pad support subassembly and configured to actuate so as to cause linear movement of the hip pad relative to the upper body support structure and the chest pad when the hip pad is angulated with respect to the chest pad, and wherein the chest pad remains stationary with respect to the upper body support structure; and a motor configured to rotate the actuator, the motor comprising an encoder that provides a digital signal which indicates a linear position of the hip pad relative to a frame of the lower body support structure.

17. The patient support apparatus of claim 16, wherein, the head end lift column further comprises a head end roll motor configured to rotate a head end roll motor shaft so as to roll the upper body support structure, and wherein the foot end lift column further comprises a foot end roll motor configured to rotate a foot end roll motor shaft so as to roll the lower body support structure and a foot end bracket assembly coupled to and suspending from the foot end roll motor shaft, the foot end bracket assembly operably coupled to the foot end of the lower body support frame.

18. The patient support apparatus of claim 16, wherein the upper and lower body support structures are coupled together via a hinge.

19. The patient support apparatus of claim 16, wherein the lower body slide actuator comprises an actuator screw configured to rotate via the lower body slide actuator, the lower body slide mechanism further comprising a nut engaged with the screw, a rod coupled with the nut, and a bracket coupled with the rod, the rod coupled with the hip pad support subassembly.

20. The patient support apparatus of claim 16, wherein the foot end support assembly further comprises a foot end articulation mechanism at a terminus of the foot end lift column opposite the foot end base, and the head end support assembly further comprises a head end articulation mechanism at a terminus of the head end lift column opposite the head end base.

21. The patient support apparatus of claim 16, wherein the lower body slide mechanism further comprises a linear guide member operably engaged with the hip pad support structure, the hip pad support structure configured to slide relative to the linear guide member.

* * * * *